US006217164B1

(12) United States Patent
Hino

(10) Patent No.: US 6,217,164 B1
(45) Date of Patent: Apr. 17, 2001

(54) INK JET RECORDER

(75) Inventor: Motohito Hino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/207,583

(22) Filed: Dec. 8, 1998

(30) Foreign Application Priority Data

| | | |
|---|---|---|
| Dec. 9, 1997 | (JP) | 9-338959 |
| Dec. 18, 1997 | (JP) | 9-349544 |
| Dec. 26, 1997 | (JP) | 9-360695 |
| Dec. 26, 1997 | (JP) | 9-360696 |
| Nov. 2, 1998 | (JP) | 10-312060 |

(51) Int. Cl.[7] ..... B41J 2/175
(52) U.S. Cl. ..... 347/85
(58) Field of Search ..... 347/32, 84, 85, 347/86, 87, 79

(56) References Cited

U.S. PATENT DOCUMENTS

| | | | |
|---|---|---|---|
| 5,359,357 | 10/1994 | Takagi et al. | 347/49 |
| 5,552,816 * | 9/1996 | Oda et al. | 347/86 |
| 5,561,448 * | 10/1996 | Kaneko et al. | 347/29 |

FOREIGN PATENT DOCUMENTS

| | | | |
|---|---|---|---|
| 5-318761 | 12/1993 | (JP) | 2/175 |

* cited by examiner

*Primary Examiner*—N. Le
*Assistant Examiner*—Anh T. N. Vo
(74) *Attorney, Agent, or Firm*—Oliff & Berridge, PLC

(57) ABSTRACT

An ink jet recorder includes a sub ink tank and a recording head which includes a manifold. The tank and the manifold are connected to an upstream supply tube and a downstream supply tube, respectively. The supply tubes can be connected by a first joint. The manifold and an upstream return tube can be connected by a second joint. The joints are fitted with filters, respectively, for removing foreign substances etc. from ink. The filters are so positioned that ink can flow upward through them. This makes it easy for the air in the ink flowing through the filters to pass buoyantly through them. Because no air stays at the filters, it is possible to increase their effective areas, and therefore secure the quantity of ink flow necessary for printing.

36 Claims, 27 Drawing Sheets

INK JET RECORDER

BACKGROUND OF THE INVENTION

1. Field of the Invention

The present invention relates to an ink jet recorder. In particular, the invention relates to an ink jet recorder with an ink supply system including an ink tank and a recording head which are connected by a supply tube.

2. Description of Related Art

A conventional ink jet recorder such as an ink jet printer includes an ink tank and a recording head, which are connected by a supply tube and a return tube. The recorder also includes a pump for circulating ink between the tank and the head.

FIGS. 27–29 of the accompanying drawings schematically show a known ink supply system. With reference to FIG. 27, an ink jet printer 100 includes a sub tank 4*a* and a head unit, which includes a print head 5*a*. The tank 4*a* and the head 5*a* are connected by two supply tubes 21*a* and two return tubes 22*a*. The upstream supply tube 21*a* is fitted with a circulating pump. The upstream supply tube 21*a* and the downstream return tube 22*a* are connected to the downstream supply tube 21*a* and the upstream return tube 22*a*, respectively, by a joint 40. The joint 40 has two passages formed through it, one of which communicates with the supply tubes 21*a*, and the other passage communicates with the return tubes 22*a*.

Each of the passages is fitted with a filter 32 for removing foreign substances etc. from ink. The head unit is mounted on a carriage, and can reciprocate at high speed over a printing medium. The reciprocating unit is followed by the upstream supply tube 21*a* and the downstream return tube 22*a*, which are connected to it. While these tubes 21*a* and 22*a* are reciprocating at high speed, waves are generated in the ink in the tubes. If the waves propagate to the head 5*a*, they affect the characteristics of ink ejection. The filters 32 for the passages also function to prevent the waves from propagating to the head 5*a*. The filters 32 are positioned horizontally so that ink can flow vertically through them. The ink flowing between the supply tubes 21*a* moves downward through the associated filter 32. The ink flowing between there turn tubes 22*a* moves upward through the other filter 32.

Otherwise, the joint 40 and the filters 32 might be positioned in such a manner that ink could flow horizontally through the filters.

Very small air bubbles may be contained in the ink supplied from the sub tank 4*a* to the recording head 5*a*. If some of the bubbles are trapped on the filter 32 in the supply line, the trapped bubbles tend to move up buoyantly, and can hardly pass through this filter. Therefore, the trapped bubbles are liable to stay or be retained on the filter 42. The staying bubbles reduces the contact or touch area between the filter 42 and ink, and therefore reduces the effective area of this filter. This prevents a sufficient amount of ink from flowing to the head 5*a*, and therefore defective recording may occur. The staying bubbles act as dampers, which may hinder or impede the intended normal ink flow when the circulating pump is driven.

As shown in FIGS. 28 and 29, the joint 40 includes a double connector 151, a seal member 152 and a holder 153, which engages with the connector. The double connector 151 includes integral twin connectors, each of which is connected to one of the upstream supply tube 21*a* and the downstream return tube 22*a*. Each of the twin connectors is fitted with one of the filters 32 on its bottom. The seal member 152 surrounds bottom portions of the twin connectors. The holder 153 includes integral twin connectors, each of which is connected to one of the downstream supply tube 21*a* and the upstream return tube 22*a*. The double connector 151 also includes lock pawls 151*a*. The holder 153 also includes lock pawls 153*a* for each engaging with one of the pawls 151*a* to keep it and the double connector 151 connected. The holder 153 further includes a ridge 153*b* formed on its top for engaging with the seal member 152 to seal the junctions between the holder 153 and the connector 151. The ridge 153*b* is positioned away from the passages in the joint 40 and the filters 32. Therefore, gaps are liable to be formed between the ridge 153*b* and each of the passages and the filters 32. Air bubbles may stay in the gaps. If the bubbles grow larger, they narrow the passages. This makes it impossible to secure the necessary amount of ink flow.

Because the joint 40 includes a number of parts, its production costs are high.

Another conventional ink jet recorder of the foregoing type includes a carriage, on which a head holder can be mounted. The head holder is fitted with a connector. The system also includes an ink tank, which is connected to a supply tube and a return tube. When the head holder is mounted on the carriage, the connector is connected to the tubes. The mounting involves positioning the head holder with high accuracy to align the connector with the tubes.

U.S. Pat. No. 5,359,357, which corresponds to Japanese Patent Application Laid-Open No. 5-318761, discloses an ink jet recorder including a carriage, a head unit, an ink supply tube and an ink return tube. Each of the tubes is connected to a connector. The elasticity of the seal rubber of the connector absorbs the displacement or misalignment of the connector from the associated tube when the head unit is mounted on the carriage. Because the amount of deformation of the seal rubber is limited, however, it is not possible to absorb a large amount of displacement.

SUMMARY OF THE INVENTION

In view of the foregoing problems, it is an object of the invention to provide an ink supply system for an ink jet recorder in which, when ink flows through the filter in the ink passage, the air trap at the filter is reduced to increase the substantially effective area of the filter.

It is another object of the invention to provide an ink supply system for an ink jet recorder in which common parts are used for the joint connecting the ink supply tubes and for the joint connecting the ink return tubes so that the number of parts and the production costs for the joints can be reduced, and in which no air bubbles stay in the joints so that good recording results can be produced.

It is still another object of the invention to provide an ink supply system for an ink jet recorder which includes small joints in the ink supply lines, the joints being able to be assembled out of parts by a simple process, and in which few air bubbles are liable to stay at the junctions between parts of the joints so that ink can be supplied always normally.

It is a further object of the invention to provide an ink supply system for an ink jet recorder in which, when the recording head is mounted on the carriage, it is possible to simply align the upstream and downstream supply tubes with each other.

In accordance with a first aspect of the invention, an ink jet recorder is provided which comprises:

a tank for storing ink;

an ink jet head for ejecting the ink onto a recording medium;

an ink tube for connecting the tank and the head, a part of the ink tube being formed such that the ink can flow upward; and an ink filter for removing foreign substances from the ink, the ink filter being fitted in the part of the ink tube.

The ink filter of this recorder is fitted in the part of the ink tube where ink can flow upward. Consequently, the air bubbles flowing with ink from the tank or the air bubbles produced in the ink pass easily with buoyancy through the filter, and are therefore restrained from being trapped by the filter. This prevents the bubbles from staying at the filter, and can therefore increase the effective area of the filter.

In general, an ink jet recorder carries out cleaning or maintenance by ejecting ink forcedly out of the ink jet head to prevent the head from clogging. The maintenance involves discharging air bubbles together with ink from the head, or recovering air bubbles into the tank.

The recorder according to the first aspect may include a pump for circulating ink between the tank and the recording head. The pump can send ink forcedly to the head. The sent ink flows upward through the filter. Therefore, during the maintenance as well, air bubbles pass easily through the filter. This results in good maintenance. The ink tube of this recorder may include a supply tube for supplying ink from the tank to the head and a return tube for returning ink from the head to the tank. The pump can circulate ink through the tubes.

The filter of this recorder may include a first filter and a second filter. The supply tube may include a part where ink can flow upward. The first filter is fitted in this tube part. The return tube may include a part where ink can flow upward. The second filter is fitted in this tube part. This enables the filter to remove foreign substance effectively in both of the tubes.

The ink jet head may be mounted on a carriage, which can move the head over the recording medium. In this case, a first joint may be fitted in that part of the supply tube where ink can flow upward. This joint has an ink passage formed therein. The first filter is fitted in the passage. When the head is removed from the carriage, the supply tube can be detached from the joint. By fitting the filter in the joint, it is easy to mount the filter and assemble the ink flow system of the recorder.

That part of the return tube where ink can flow upward may be the part connecting the ink jet head and the return tube. It is easy to control the ink flow in this connecting part in such a manner that ink flows upward. A second joint may be fitted in this part of the return tube, and has an ink passage formed therein. The second filter is fitted in this passage. This makes it easy to mount the filter in the return tube and assemble the ink flow system of the recorder.

The supply tube may be formed such that the ink can flow upward. The return tube may may be formed such that the ink can flow upward. An integral joint may be fitted in these parts. This joint may have a first passage and a second passage formed therein, and communicating with the supply and return tubes, respectively. The filter may include a plane filter crossing the passages. The filter may be positioned in the joint in such a manner that the ink flowing through the passages moves obliquely through the filter. In this case, because ink can pass through the filter inclined with respect to its flow, the contact area between the filter and ink widens. This makes it possible to remove foreign substances efficiently. In order that the filter may incline with respect to the ink flow, the first and second passages may be bent with respect to the ink flow through the supply and return tubes, respectively.

The ink jet head of this recorder may have an array of ink channels formed therein. The tank of this recorder may be a detachable ink cartridge. The invention may also be applied to a recorder with which an ink cartridge is used.

In accordance with a second aspect of the invention, an ink jet recorder is provided which comprises:

a tank for storing ink;

an ink jet head for ejecting the ink;

a supply tube for supplying the ink from the tank to the head, the supply tube having an upstream supply tube connected to the tank and a downstream supply tube connected to the head;

a return tube for returning the ink from the head to the tank, the return tube having an upstream return tube connected to the head and a downstream return tube connected to the tank;

a pump for circulating the ink through the tubes between the tank and the head;

a first joint for connecting the upstream and downstream supply tubes;

a second joint for connecting the upstream and downstream return tubes;

each of the joints including a seal member having a passage formed therethrough, such that the passage widens toward one open end of the seal member;

one of the joints including a first connector having an open end for connection to the open end of the seal member, the first connector having a passage formed in the open end thereof such that the connector passage widens toward the open end of the first connector; and a filter fitted in one of the open ends of the first connector and the associated seal member;

the other joint including a second connector having a convex part shaped for engagement with the passage in the associated seal member, the second connector having a passage formed therein.

In accordance with a third aspect of the invention, an ink jet recorder is provided which comprises:

a tank for storing ink;

an ink jet head for ejecting the ink;

a supply tube for supplying the ink from the tank to the head, the supply tube having an upstream supply tube connected to the tank and a downstream supply tube connected to the head;

a return tube for returning the ink from the head to the tank, the return tube having an upstream return tube connected to the head and a downstream return tube connected to the tank;

a pump for circulating the ink through the tubes between the tank and the head;

a first joint for connecting the upstream and downstream supply tubes;

a second joint for connecting the upstream and downstream return tubes;

one of the joints including a first seal member and a first connector;

the first seal member having a passage formed therethrough such that the passage widens toward one open end of the first seal member;

the first connector having an open end for connection to the open end of the first seal member, the first connector having a passage formed in the open end thereof such that the first connector passage widens toward the open end of the first connector; and a filter fitted in one of the open ends of the first connector and the first seal member;

the other joint including a second connector and a second seal member;

the second connector being substantially identical in shape with the first connector, the second connector having a passage formed therein such that the second connector passage widenes toward the open end of the second connector;

the second seal member having a convex open end shaped for engagement with the second connector passage, the second seal member having a passage formed therein.

In the recorder according to the second or third aspect, each of the joints includes a connector and a seal member. One of the joints is fitted with a filter, and the other may be fitted with no filter. The connectors or the seal members of the joints may be identical in structure. This makes the connectors or the seal members common to the joints, reducing the production costs for the recorder.

In the recorder according to the second or third aspect, the joint fitted with the filter and the associated tubes may be positioned in such a manner that ink can flow upward through the filter. This causes air bubbles to flow easily through the filter, increasing its effective area. The passages widening outward may be conical, and each of the convex part and end may be shaped for compressive contact with the conical surface of the associated passage. This makes it possible to engage each of the connectors securely with the associated seal member. The connectors of the joints may be integral. This makes the parts of the joints fewer. This also makes it possible to engage the connectors with the seal members in one step. The joints may be fitted to a head unit, on which the recording head can be mounted.

In accordance with a fourth aspect of the invention, an ink jet recorder is provided which comprises:

an ink tank;

an ink jet head;

a first tube connected to the head;

a second tube connected to the tank;

a connecting member for connecting the first and second tubes, the connecting member including a first connector and a second connector each having a passage formed therein, the passage having a conical open end for connection to the conical open end of the passage in the other connector; and a filter interposed between the connectors;

the second connector being made of sealing material.

The structure of this connecting member needs no such special seal member in conventional printer as shown in FIGS. 28 and 29. The inventive connection member can reduce the number of parts and the production costs for the recorder. The connecting member may be so positioned that ink can flow upward through the filter.

This recorder may further comprise a head holder, which holds the ink jet head, and a mounting member for mounting the connectors on the holder. The second connector may be a seal member. By engaging the first connector with the mounting member, it is possible to keep this connector and the seal member connected. Because the engagement of the first connector with the mounting member connects this connector and the seal member on the head holder, the connection can be maintained securely.

Each of the first and second tubes of this recorder may include a supply tube and a return tube for circulating ink between the ink tank and the ink jet head. The connecting member of this recorder may include first and second connecting members, each of which includes the first and second connectors. The first connecting member can connect the supply tubes of the first and second tubes. The second connecting member can connect the return tubes of the first and second tubes.

The first connectors of the two connecting members may be integral with each other. The seal members of the two connecting members may be integral with each other. This makes it possible to engage the first connectors with the seal members at a time for the supply and return tubes. It is therefore possible to simplify the process for engaging parts, and improve the productivity.

Each of the first connector and the seal member of each connecting member may have an end surface for contact with the end surface of the other. The end surface of one of the first connector and the seal member of each connecting member may have a ridge formed thereon for sealing between the end surfaces of the first connector and the seal member. This can shorten the distance between the ridge and the associated filter, and the distance between the ridge and ink. Therefore, gaps are hardly or difficultly produced between the ridge and the filter, and between the ridge and ink. Consequently, few air bubbles are liable to stay in the connecting member.

In accordance with a fifth aspect of the invention, an ink jet recorder is provided which comprises: an ink tank;

a head holder;

an ink jet head mounted on the holder for ejecting ink onto a recording medium;

a carriage for mounting the holder thereon and moving the head over the medium;

a first tube connected to the head;

a second tube connected to the tank;

a connecting member for connecting the first and second tubes; and a mounting member for mounting the connecting member on one of the holder and the carriage;

a retainer formed on one of the head holder and the carriage so that the retainer retains the mounting member with play.

The mounting member of this recorder enables the connecting member to be mounted on the head holder or the carriage with a little play. This makes it possible to change the position of the connecting member relative to the holder or the carriage a little within the range of the play.

The first tube of this recorder may be fitted to the head holder. The second tube may be fitted to the carriage. The two fitted tubes may be displaced or misaligned ("s" in FIG. 11). Even in this case, when the holder is mounted on the carriage, the connecting member can be positioned within the range of the play between the connecting member and the retainer formed on the head holder or the carriage to absorb or compensate the displacement between the tubes. This can connect the two tubes securely.

The connecting member of this recorder may be fitted with a filter therein. As is the case with the recorder according to the first aspect, the connecting member, the filter and/or the tube may be positioned in such a manner that ink can flow upward through the filter.

The mounting member can be retained in the inner side of the retainer with play which is substantially perpendicular to the axis of the connecting member. One or both of the mounting member and the retainer may include a protrusion formed thereon for preventing the mounting member from falling axially of the connecting member. The protrusion keeps the mounting member from falling axially of the connecting member, and allows the mounting member to move substantially radially of the connecting member. This keeps the connecting member securely from falling, and allows it to move laterally.

The protrusion may be made of material which can elastically deform in such directions as to allow the mounting member to be retained within the retainer. The elastically deformable protrusion makes it easy to engage the mounting member with and disengage from the retainer.

The connecting member may include a first connector connected to the first tube and a second connector connected to the second tube. The first and second connectors are fitted to the mounting member, such as a joint holder, and the carriage, respectively as shown in FIG. 11. The connectors can connect the two tubes easily and securely, and make it easy to make the head holder detachable from the carriage.

Each of the first and second tubes may include a supply tube and a return tube for circulating ink between the ink tank and the ink jet head. The connecting member may include first and second connecting members, each of which includes the first and second connectors. The first connecting member can connect the supply tubes of the two tubes. The second connecting member can connect the return tubes of the first and second tubes. Part of the ink supplied through the supply tubes to the head can return through the return tubes to the tank.

Each of the first and second connecting members may also include a seal member interposed between the first and second connectors to connect the first and second connectors. The first connector of each connecting member may be connected to the supply tube or the return tube of the first tube. The second connector of each connecting member may be connected to the supply tube or the return tube of the second tube. Because the seal member can connect the associated connectors, they can be connected securely.

The first and second connectors may be fitted to the head holder and the carriage, respectively. One or both of the connectors of each connecting member may be fitted with a little play. The play makes it possible to connect the connectors easily and securely even if they are displaced from each other.

This recorder is suitable as an ink jet recorder of the type in which the ink tank is fixed in the recorder.

BRIEF DESCRIPTION OF THE DRAWINGS

Preferred embodiments of the invention will be described with reference to the accompanying drawings, in which.

DETAILED DESCRIPTION OF PREFERRED EMBODIMENTS

Figure 1:
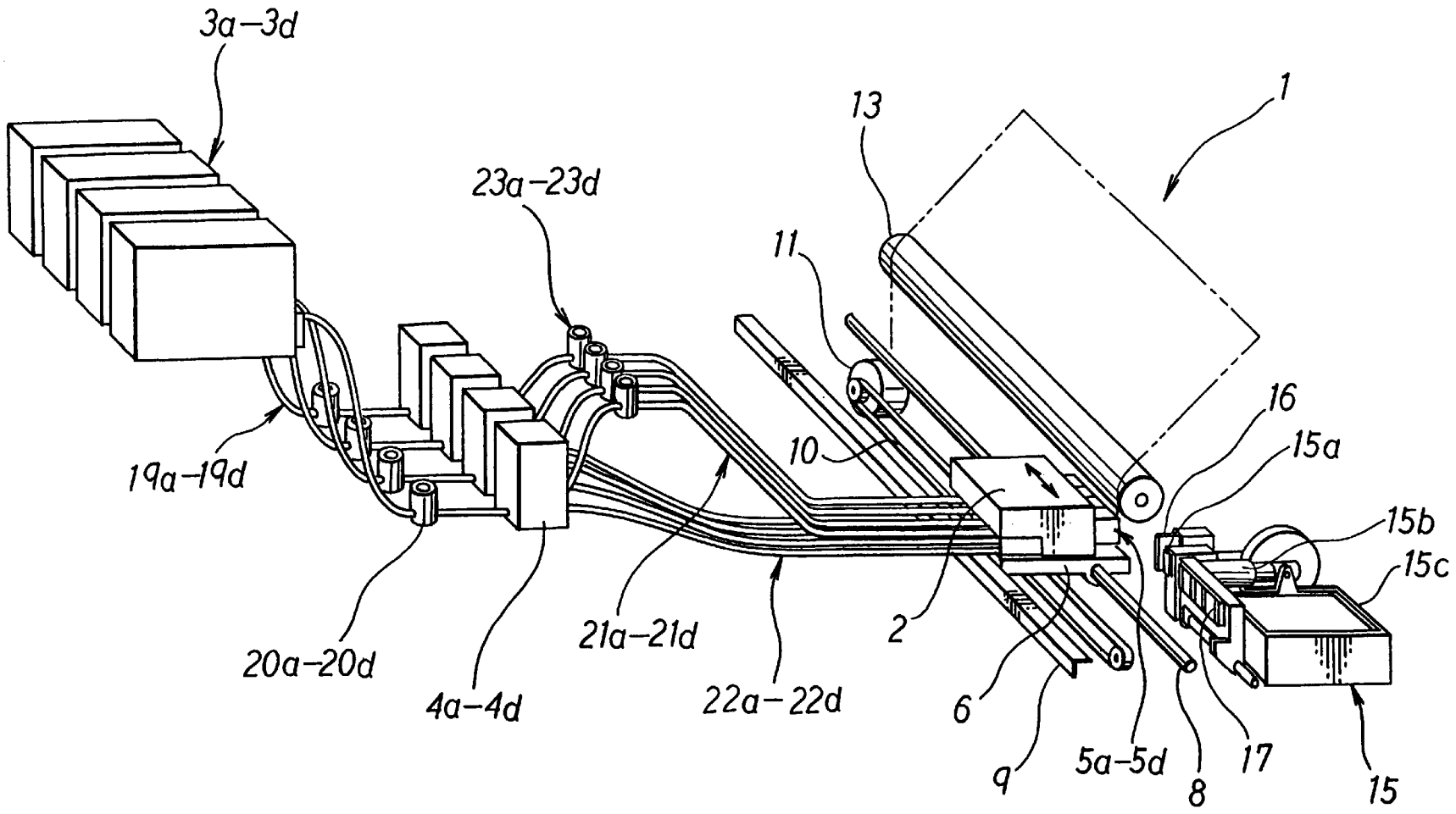
FIG. 1 is a schematic view of part of an ink jet recorder according to a first embodiment of the invention.

With reference to FIG. 1, an ink jet color recorder 1 according to a first embodiment of the invention includes a frame (not shown), which supports a horizontal feed roller 13. The roller 13 can be turned by a drive mechanism (not shown), which includes a feed motor, to feed recording paper P perpendicularly to the roller axis. The frame also supports a guide bar 8 and a guide rail 9, which extend in parallel with the feed roller 13. A carriage 6 is supported slidably on the bar 8 and the rail 9, and can be reciprocated along them by a timing belt 10, which can be driven by a carriage motor 11. A head unit 2 for color recording is mounted removably on the carriage 6, and can scan the paper P as the carriage is reciprocated. The head unit 2 includes four recording heads 5*a*–5*d* for ejecting ink onto the paper P.

While the recording heads 5*a*–5*d* are used, air bubbles may be produced in them, and ink droplets may stick to their ejection faces. This may cause defective ejection of ink. Positioned on one side of the feed roller 13 is a maintenance unit, which includes a purging device 15 and a wiper 16 for recovering normal ejection of ink. The purging device 15 includes a suction cap 15*a* for close contact with the ejection face of one of the heads 5*a*–5*d* at a time. The cap 15*a* is connected to a pump 15*b*, which can develop a negative pressure for sucking the bubbles in the head 5*a*, 5*b*, 5*c* or 5*d* capped with the cap, bad ink, etc. The sucked ink is sent to a reservoir 15*c*. The wiper 16 can wipe away the ink dregs or sediment, etc. stuck to the ejection faces of the heads 5*a*–5*d*. Positioned on one side of the purging device 15 is a capping device 17 for preventing the heads 5*a*–5*d* from drying while they are not used.

The recorder 1 also includes four main tanks 3*a*–3*d* filled with ink for supply to the head unit 2. The recorder 1 further includes four sub tanks 4*a*–4*d* for temporarily storing the ink from the main tanks 3*a*–3*d*, respectively. Ink can be circulated between the head unit 2 and the sub tanks 4*a*–4*d*. The recording heads 5*a*–5*d* can be supplied with ink from the main tanks 3*a*–3*d* and the sub tanks 4*a*–4*d*, respectively. The main tanks 3*a*–3*d* are connected to the sub tanks 4*a*–4*d* by tubes 19*a*–19*d*, respectively. The tubes 19*a*–19*d* are fitted with pumps 20*a*–20*d* for supplying ink from the main tanks 3*a*–3*d*, respectively.

Figure 2:
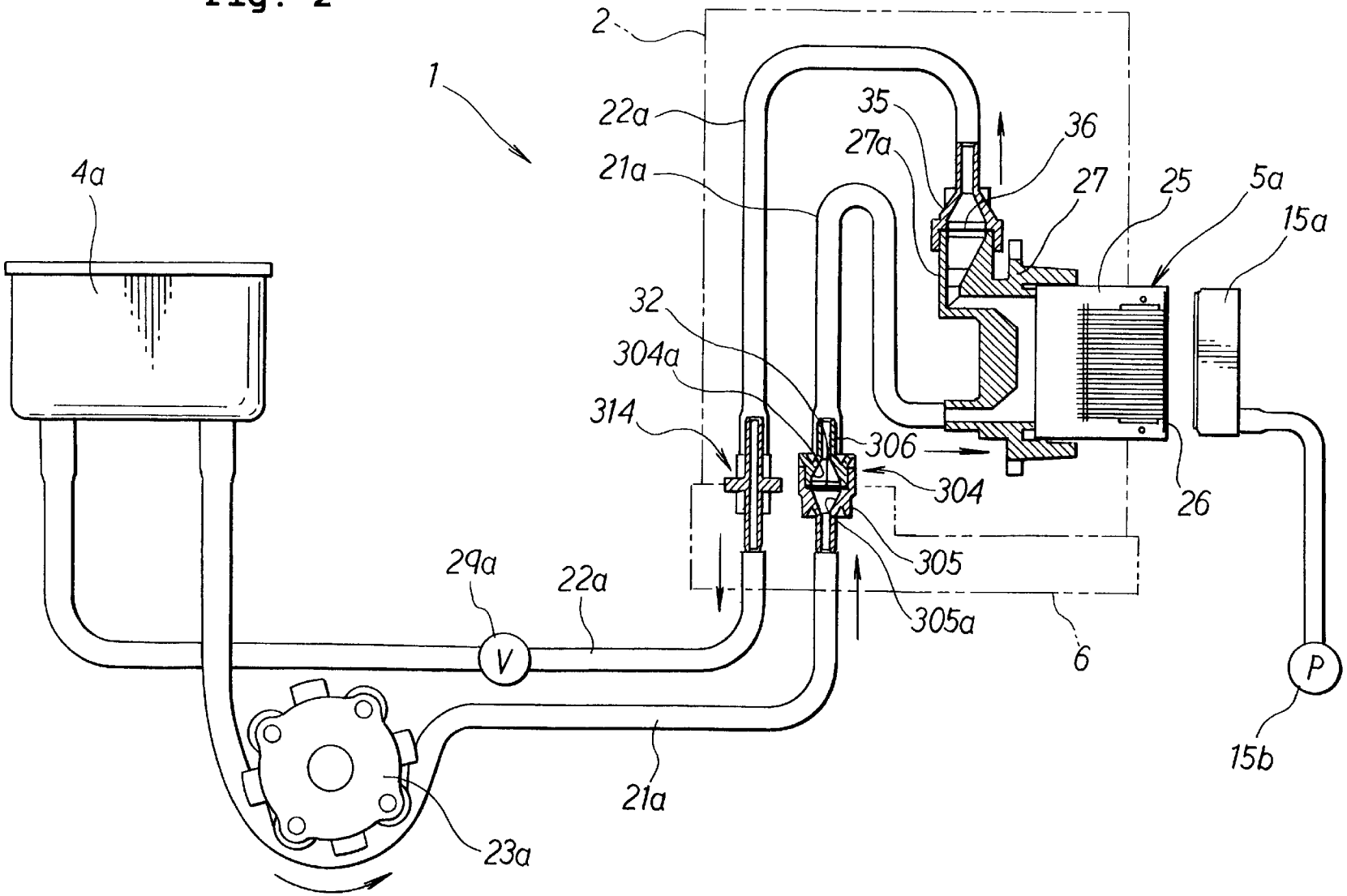
FIG. 2 is a schematic view showing the ink supply system for one of the recording heads of this recorder.

FIG. 2 shows the ink supply system for the recording head 5*a*. The heads 5*a*–5*d* and the ink supply systems for them are identical or similar in structure.

The sub tanks 4*a*–4*d* are connected to the recording heads 5*a*–5*d* by pairs of flexible supply tubes 21*a*–21*d* and pairs of flexible return tubes 22*a*–22*d*, respectively. The upstream supply tube 21*a*–21*d* are fitted with pumps 23*a*–23*d* for supplying ink from the sub tanks 4*a*–4*d*, respectively. Each of the pumps 23*a*–23*d* includes four rollers, which can revolve around its axis to squeeze the associated upstream supply tube 21*a*, 21*b*, 21*c* or 21*d*. The pumps 23*a*–23*d* might be replaced with pumps of another known type. The downstream return tubes 22*a*–22*d* are fitted with valves 29*a*–29*d*.

The interior of each of the sub tanks 4*a* has partitions or walls defining a labyrinth or maze of passages. Ink can flow from each of the main tanks 3*a*–3*d* and the associated downstream return tubes 22*a*, 22*b*, 22*c* or 22*d* into the associated sub tank 4*a*, 4*b*, 4*c* or 4*d*, where the ink flows through the maze before it is supplied to the associated upstream supply tube 21*a*, 21*b*, 21*c* or 21*d*. While the ink is flowing through the maze, air bubbles in the ink can separate buoyantly from it to be discharged into the atmosphere.

Each of the recording heads 5*a*–5*d* includes an actuator 25, a nozzle plate 26 and a manifold 27. The actuator 25 has an array of ink channels formed in it. The plate 26 has nozzles formed through it and each communicating with one of the channels. The manifold 27 can distribute the ink from the associated sub tank 4*a*, 4*b*, 4*c* or 4*d* to the channels, and is connected to the associated downstream supply tube 21*a*, 21*b*, 21*c* or 21*d* and upstream return tube 22*a*, 22*b*, 22*c* or 22*d*. The carriage 6 is fitted with joints 304 and 314, which are positioned nearby. Each of the upstream supply tubes 21*a*–21*d* are connected to the associated downstream supply tube by one of the joints 304. Each of the upstream return tubes 22*a*–22*d* are connected to the associated downstream return tube by one of the joints 314.

Each of the joints 304 for the supply tubes 21*a*–21*d* consists of a lower connector 305 and an upper connector 306, which are connected to the associated downstream and upstream supply tubes, respectively. The connectors 306 and 305 for each of the supply tubes 21*a*–21*d* have conical bores 304*a* and 305*a* formed therein, respectively. The bore 304*a* or 305*a* of each of the connectors 306 and 305 widens or diverges toward its outer end, which can come into contact with the outer end of the other connector. Each of the upper connectors 306 is fitted with a filter 32 for removing foreign substances etc. from the ink flowing through it. The upper connectors 306 are fixed to the bottom of the head unit 2. The lower connectors 305 are fixed to the top of the carriage 6. As a result, the outlets of the upstream supply tubes 21*a*–21*d* are positioned in the carriage 6, while the inlets of the downstream supply tubes 21*a*–21*d* are positioned above the carriage 6. Therefore, when ink flows through the filters 32 of the upper connectors 306, it moves upward.

Each of the upstream return tubes 22*a*–22*d* is connected to the associated manifold 27 by a connector 35, which is fixed to the tube. The connector 35 has a conical bore formed in it and widening toward its outer end. The connector 35 is fitted with a filter 36 for removing foreign substances etc. from the ink flowing through it. The manifold 27 includes an outlet port 27*a* formed at its top. The outer end of the port 27*a* faces upward, and engages with the connector 35. The port 27*a* has a bore formed in it and widening toward its outer end. When ink flows from the manifold 27 to the associated upstream return tube 22*a*, 22*b*, 22*c* or 22*d*, it moves upward through the filter 36.

Ink can flow in the ink circulation system as follows.

When each of the valves 29*a*–29*d* is opened and the associated pump 23*a*, 23*b*, 23*c* or 23*d* is driven, the associated manifold 27 is filled with ink from the associated sub tank 4*a*, 4*b*, 4*c* or 4*d* through the associated supply tubes 21*a*, 21*b*, 21*c* or 21*d*. The surplus ink returns through the associated return tubes 22*a*, 22*b*, 22*c* or 22*d* to the tank 4*a*, 4*b*, 4*c* or 4*d*. While the manifold 27 is filled with ink, ink circulates through the filters 32 and 36 between the tank 4*a*, 4*b*, 4*c* or 4*d* and the associated recording head 5*a*, 5*b*, 5*c* or 5*d*. When the pump 15*b* of the purging device 15 is driven with the suction cap 15*a* in contact with the nozzle plate 26 of the head 5*a*, 5*b*, 5*c* or 5*d*, ink is sucked from the manifold 27 and filled into the channels in the head. Thereafter, the pump 23*a*, 23*b*, 23*c* or 23*d* is stopped in such a position that the upstream supply tubes 21*a*, 21*b*, 21*c* or 21*d* is not choked, and the associated valve 29*a*, 29*b*, 29*c* or 29*d* is closed. As ink is ejected for recording from the head 5*a*, 5*b*, 5*c* or 5*d*, the manifold 27 is replenished with ink from the tank 4*a*, 4*b*, 4*c* or 4*d* through the supply tubes 21*a*, 21*b*, 21*c* or 21*d*. Air bubbles in the ink in the circulation line may gradually incorporate together and grow larger, narrowing or blocking the ink passages. This can be prevented by a periodic or manual operation which includes opening the valve 29*a*, 29*b*, 29*c* or 29*d* and driving the pump 23*a*, 23*b*, 23*c* or 23*d* to circulate ink between the tank 4*a*, 4*b*, 4*c* or 4*d* and the head 5*a*, 5*b*, 5*c* or 5*d* as stated above. The circulation recovers air bubbles from the supply tubes 21*a*, 21*b*, 21*c* or 21*d*, the manifold 27 and the return tubes 22*a*, 22*b*, 22*c* or 22*d* into the tank 4*a*, 4*b*, 4*c* or 4*d*, where the recovered bubbles are separated buoyantly from the ink while the ink is flowing through the maze of passages in the tank as stated above. As a result, the manifold 27 is supplied with ink containing a reduced number of air bubbles through the supply tubes 21*a*, 21*b*, 21*c* or 21*d*.

Each of the sub tanks 4*a*–4*d* is fitted with a level sensor (not shown), which detects the amount of ink stored in the tank. On the basis of the value detected by the sensor, the associated pump 20*a*, 20*b*, 20*c* or 20*d* (FIG. 1) is controlled to supply the associated sub tank 4*a*, 4*b*, 4*c* or 4*d* with ink from the associated main tank 3*a*, 3*b*, 3*c* or 3*d* so that a predetermined amount of ink is maintained always in the sub tank.

Thus, when ink flows through the filters 32 and 36 of the connectors 304 and 35, it moves upward. Therefore, air bubbles flowing together with ink upward to the filters 32 and 36 pass through them easily with buoyancy, and are hardly trapped by them. This prevents air bubbles from staying at the filters 32 and 36. Consequently, the effective areas of the filters 32 and 36 increase substantially. It is therefore possible to secure the quantity of ink flow which is necessary for recording. As a result, defective recording occurs hardly When ink circulates through the filters 32 and 36, and/or when the purging device 15 sucks ink, no damper acts at the filters. It is therefore possible to realize a smooth air flow.

The recorder 1 may be modified in various ways. Each of the filters 32 might be fitted to the associated lower connector 305 in place of the associated upper connector 306, or interposed between them. Each of the filters 36 might be fitted to the outlet port 27*a* of the associated manifold 27 in place of the connector 35. The filters 32 and 36 might be positioned elsewhere in the recorder 1, as far as they are supported in such a manner that ink can flow upward through them.

Figure 3:
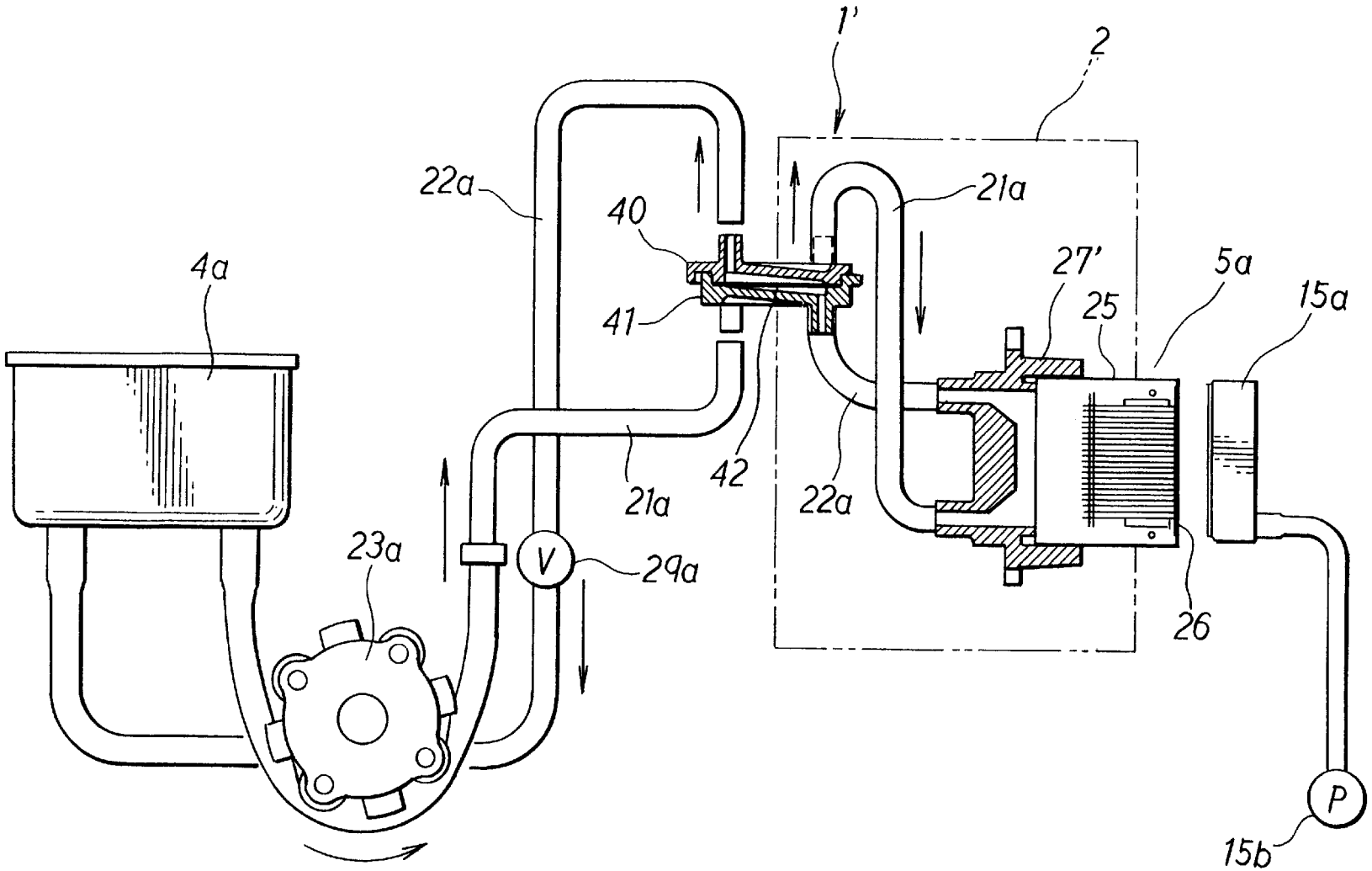
FIG. 3 is a schematic view showing the ink supply system for one of the recording heads of an ink jet recorder according to a second embodiment of the invention.

FIG. 3 shows the ink supply system for one of the recording heads 5*a*–5*d* (only 5*a* shown) of an ink jet color recorder 1 according to a second embodiment of the invention.

Each of these recording heads 5*a*–5*d* includes a manifold 27, which is connected directly to a downstream supply tube 21*a*, 21*b*, 21*c* or 21*d* and an upstream return tube 22*a*, 22*b*, 22*c* or 22*d*. The recorder 1 includes sub tanks 4*a*–4*d*, which are connected to upstream supply tubes 21*a*–21*d* and downstream return tubes 22*a*–22*d*, respectively. The upstream supply tubes 21*a*–21*d* and the downstream return tubes 22*a*–22*d* are connected to the downstream supply tubes 21*a*–21*d* and the upstream return tubes 22*a*–22*d*, respectively, by upper connectors 40 and lower connectors 41. In FIG. 3, the upstream supply tube 21*a*, the downstream return tube 22*a* and the associated connectors 40 and 41 are shown as disconnected.

Figure 4:
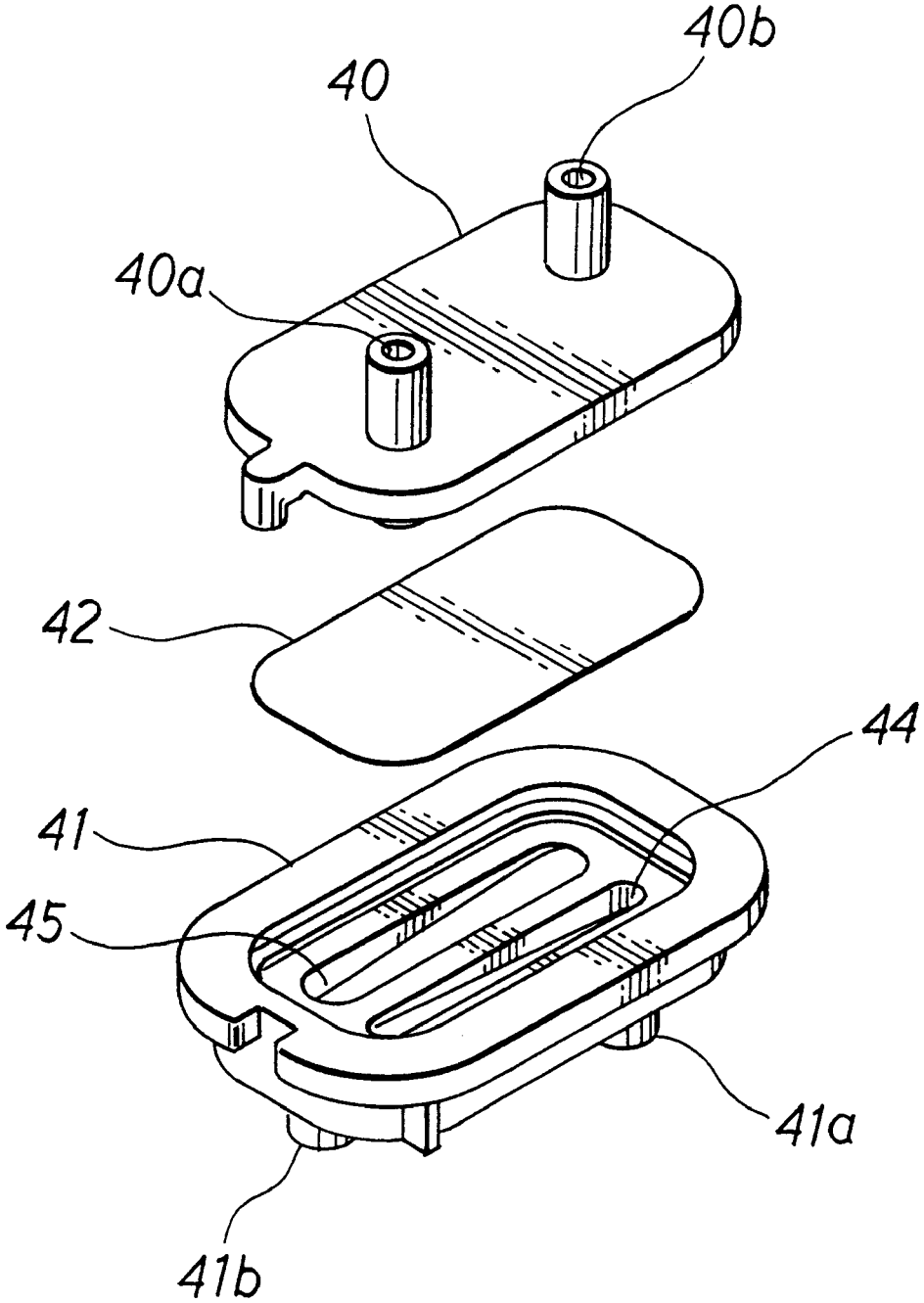
FIG. 4 is an exploded perspective view of the connectors and the filter of this supply system.
Figure 5:
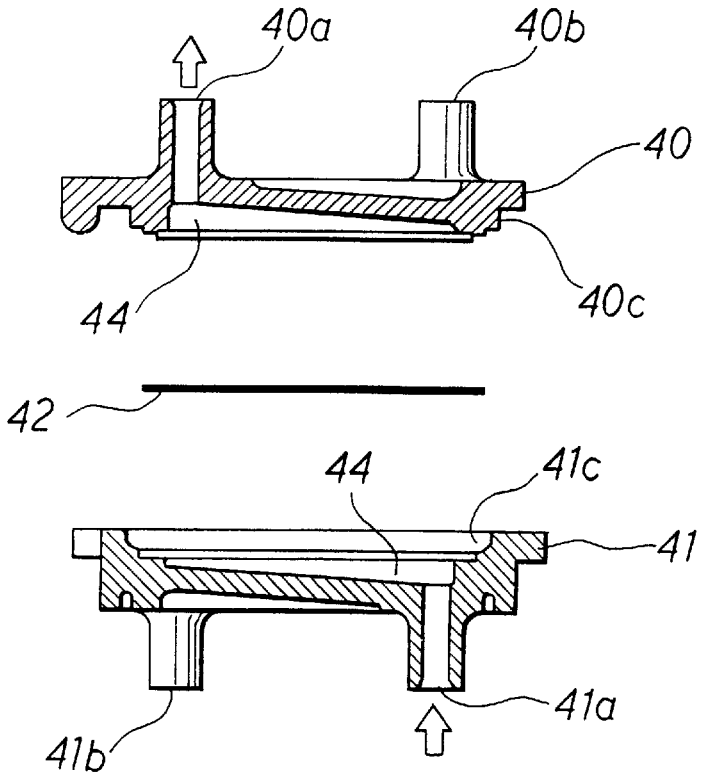
FIG. 5 is an exploded vertical section of these connectors and this filter.
Figure 6:
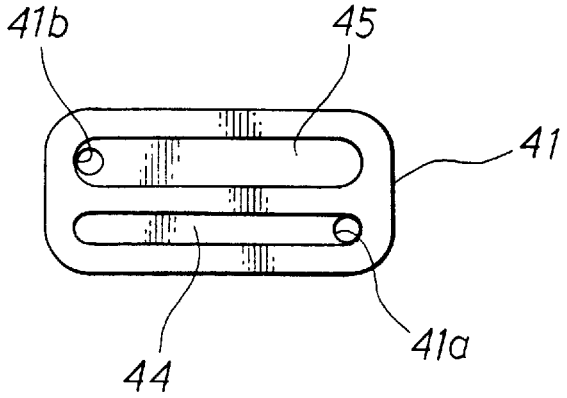
FIG. 6 is a top view of the lower connector of this supply system.

With reference to FIGS. 4–6, each of the connectors 40 and 41 has a wider groove and a narrower groove formed in it. Each upper connector 40 includes outlet pipes 40*a* and 40*b* formed near both its ends. The pipes 40*a* and 40*b* communicate with the adjacent ends of the narrower and wider grooves, respectively, of the upper connector 40. Each lower connector 41 includes inlet pipes 41*a* and 41*b* formed near both its ends. The pipes 41*a* and 41*b* communicate with the adjacent ends of the narrower and wider grooves, respectively, of the lower connector 41. The inlet pipe 41*b* and the outlet pipe 40*b*, which communicate with the wider groove, are connected to the associated upstream and downstream supply tubes 21*a*, 21*b*, 21*c* or 21*d*, respectively. The inlet pipe 41*a* and the outlet pipe 40*a*, which communicate with the narrower groove, are connected to the associated upstream and downstream return tubes 22*a*, 22*b*, 22*c* or 22*d*, respectively.

When each connector 40 and the associated connector 41 engage with each other, their wider grooves register or align with each other to form a supply passage 45, and their narrower grooves register with each other to form a return passage 44. As shown in FIG. 5, the ink from the inlet pipe 41*a* of the lower connector 41 flows from the adjacent end of the return passage 44 to the other end into the outlet pipe 40*a* of the upper connector 40. Likewise, the ink from the inlet pipe 41*b* flows from the adjacent end of the supply passage 45 to the other end into the outlet pipe 40*b*.

Each upper connector 40 has a protrusion 40*c* formed on its bottom. Each lower connector 41 has a recess 41*c* formed in its top for engagement with the protrusion 40*c*. When the protrusion 40*c* of each connector 40 engages with the recess 41*c* of the associated connector 41, the grooves in one of the connectors 40 and 41 register with the associated grooves in the other. A filter 42 is fitted in the recess 41*c* in such a manner that the filter covers the two grooves of the lower connector 41. By engaging the protrusion 40*c* with the recess 41*c*, it is possible to position the three members easily and securely. After the engagement, it is possible to seal the passages 44 and 45 securely by welding or bonding the connectors 40 and 41 by means of heat or ultrasonic waves, or joining them otherwise, with the filter 42 interposed between them.

The ink flowing through each upstream supply tube 21*a*, 21*b*, 21*c* or 21*d* and the associated downstream supply tube passes upward through the filter 42. The ink flowing through each upstream return tube 22*a*, 22*b*, 22*c* or 22*d* and the associated downstream return tube passes upward through the same filter 42.

The pipes 40*a* and 41*a* for the return passage 44 are positioned at both its ends. The pipes 40*b* and 41*b* for the supply passage 45 are positioned at both its ends. Therefore, when ink flows through the connectors 40 and 41, it passes through relatively long areas of the filter 42 in the passages 44 and 45. This increases the contact area between the filter 42 and ink. It is therefore possible to efficiently remove foreign substances etc. from the ink flowing through the filter 42.

Figure 7:
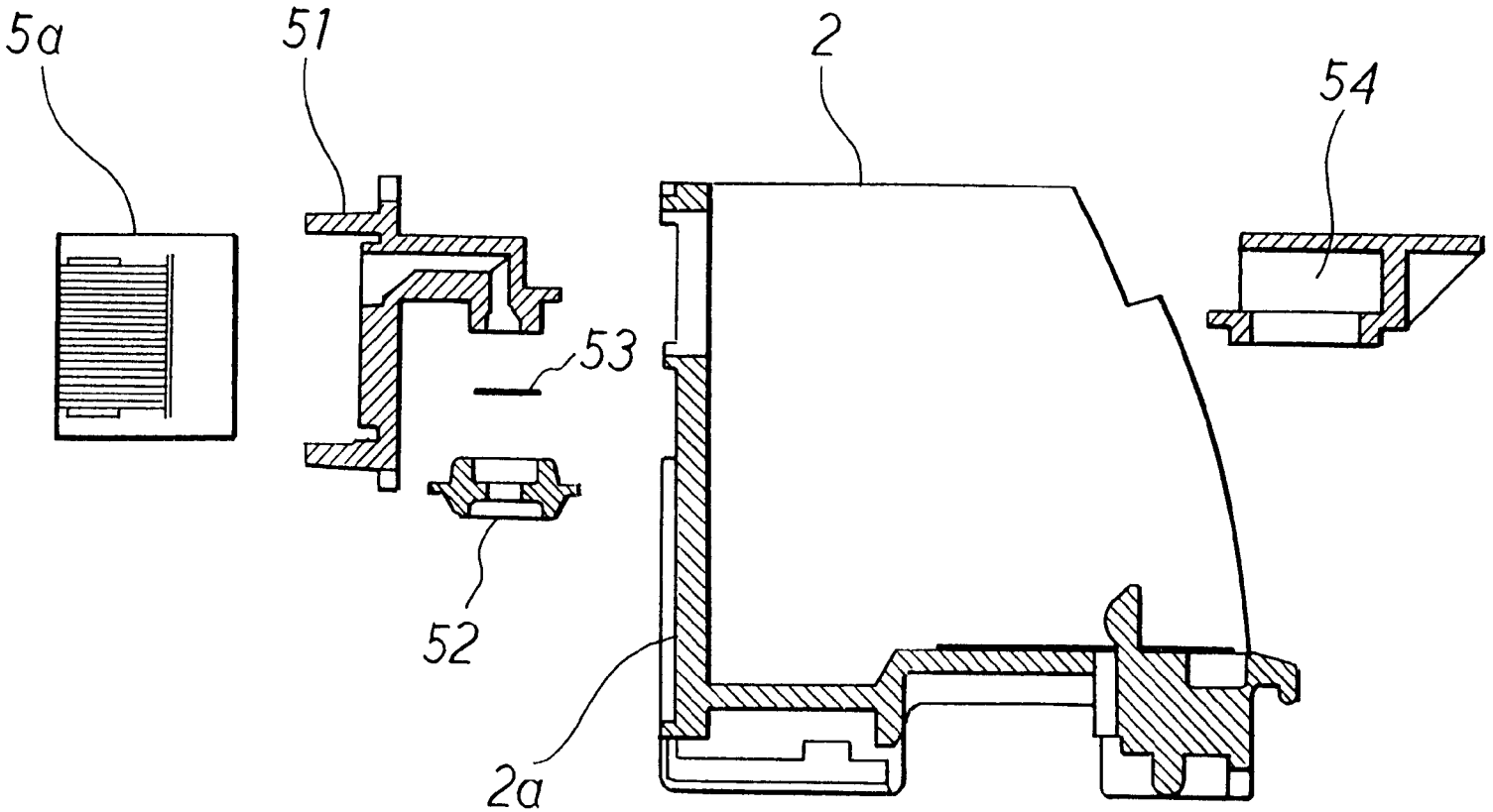
FIG. 7 is an exploded vertical section of the head unit of an ink jet recorder according to a third embodiment of the invention.
Figure 8:
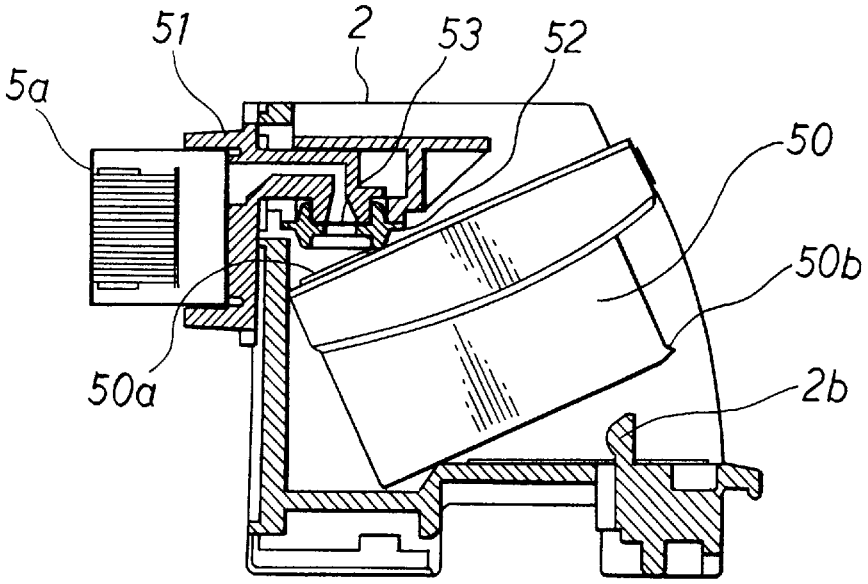
FIG. 8 is a vertical section showing the step of mounting an ink cartridge on this head unit.
Figure 9:
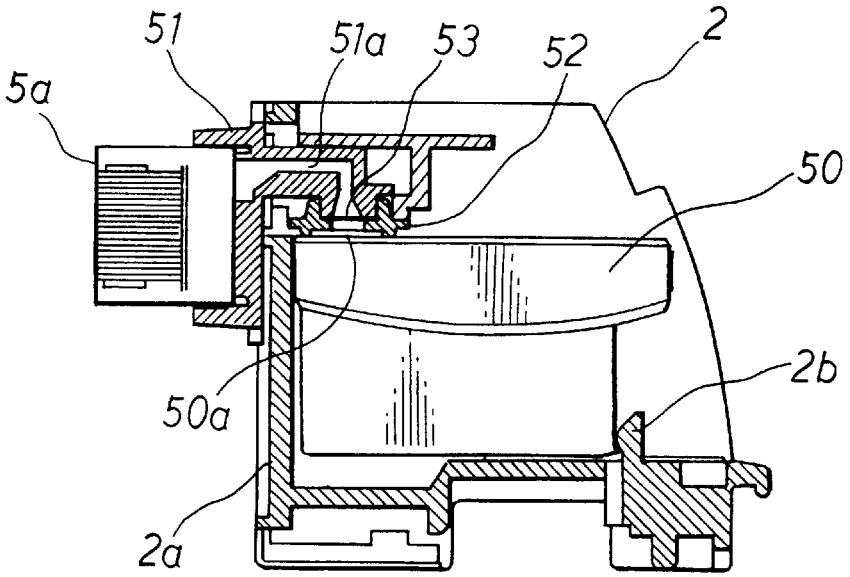
FIG. 9 is a vertical section showing this cartridge mounted on this head unit.

With reference to FIGS. 7–9, an ink jet recorder according to a third embodiment of the invention includes a head unit 2, which includes a head holder 2*a*. A manifold 51 is fixed to the front wall of the head holder 2*a* with a manifold holder 54. A recording head 5*a* is mounted on the manifold 51, and has an array of nozzles formed in it. An ink cartridge or tank 50 can be mounted on the head holder 2*a* to supply the head 5*a* with ink, and has an outlet 50*a* formed at its top. The manifold 51 has a bore 51*a* formed through it. The bore 51*a* includes an inlet port facing downward, a vertical part extending upward from this port, and a horizontal part extending forward from the top of the vertical part. The inlet port of the bore 51*a* is fitted with a seal member 52, which may be made of rubber. The bore 51*a* can communicate with the cartridge outlet 50*a* through the seal member 52. A filter 53 is interposed between the seal member 52 and the inlet port of the bore 51*a*. The manifold 51 and the seal member 52 function as ink supply paths.

The head holder 2*a* includes a pawl or hook 2*b* formed at its bottom. The ink cartridge 50 includes a protrusion 50*b* formed on its rear wall. It is possible to mount the cartridge 50 on the head holder 2*a* by putting the cartridge in this holder, as shown in FIG. 8, in such a manner that the cartridge outlet 50*a* is positioned under the seal member 52 and the filter 53, and by then engaging the cartridge protrusion 50*b* with the holder pawl 2*b*, as shown in FIG. 9.

This recorder includes a purging device (not shown), which is similar to the device 15 shown in FIG. 1. Before the recorder starts recording, with the ink cartridge 50 mounted on the head holder 2*a*, the purging device sucks ink from the recording head 5*a* through the nozzles. This causes ink to flow out of the cartridge 50 through the outlet 50*a*, pass through the seal member 52, the filter 53 and the manifold bore 51*a*, and flow into the head 5*a*. During the recording, the head 5*a* is replenished with ink from the cartridge 50 by the pressure drop due to the ejection of ink from the head.

When ink flows through the filter 53, it moves upward. Therefore, air bubbles flowing with ink upward to the filter 53 pass through it easily with buoyancy, and are hardly or difficultly trapped by it. In particular, when the ink cartridge 50 is mounted, a large number of air bubbles are sandwiched between its outlet 50*a* and the filter 53. However, the filter 53 traps few of these bubbles.

Figure 10:
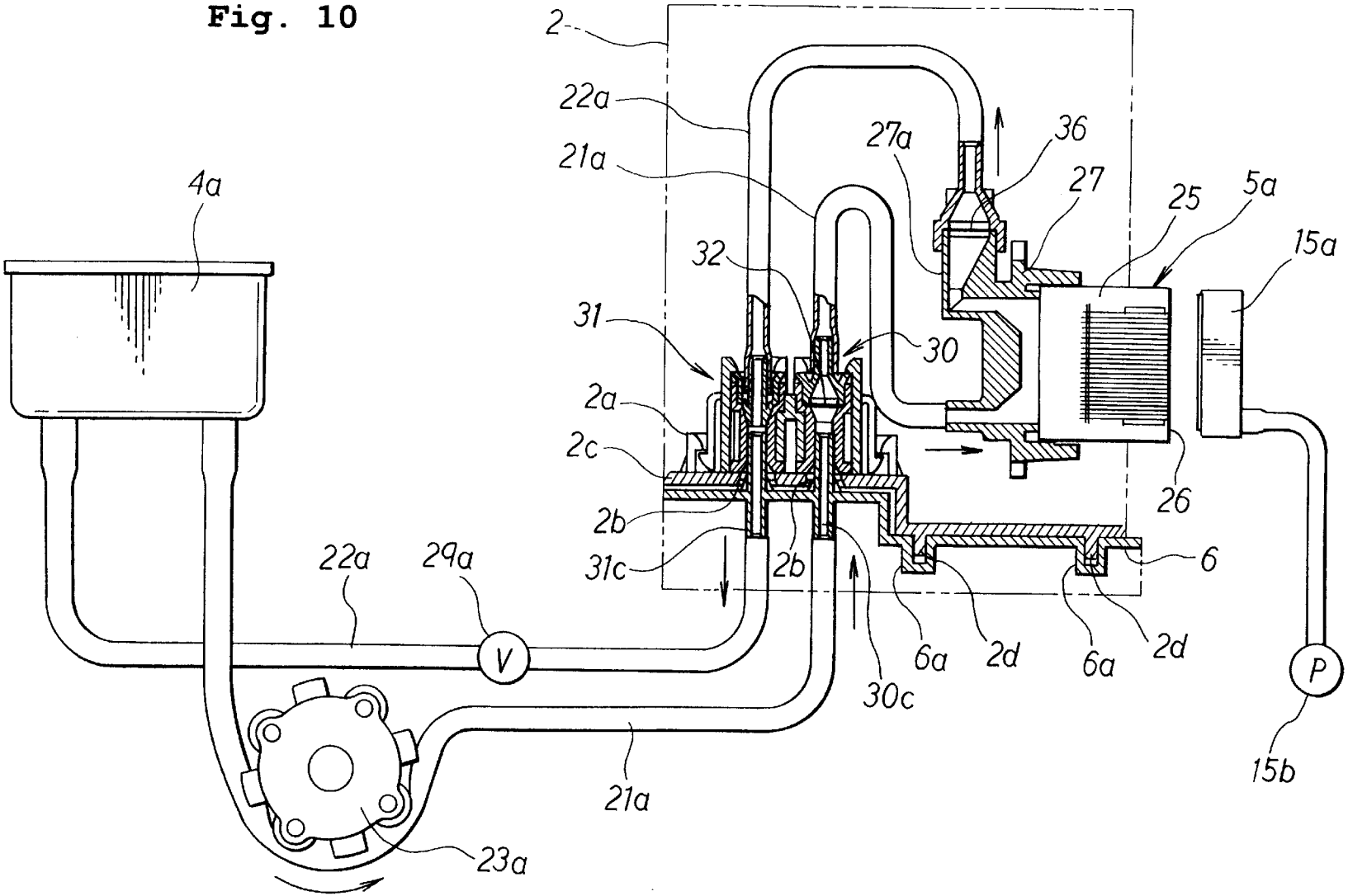
FIG. 10 is a schematic view showing the ink supply system for one of the recording heads of an ink jet recorder according to a fourth embodiment of the invention.

FIG. 10 shows the ink supply system for one of the recording heads 5*a*–5*d* (only 5*a* shown) of an ink jet color recorder according to a fourth embodiment of the invention. The heads 5*a*–5*d* are held by a head holder 2*c*, which is the outer casing of the head unit 2. The head holder 2*c* has four pairs of holes 2*b* formed through its bottom plate. The head unit 2 is mounted on a carriage 6.

In particular, this recorder includes four pairs of joints 30 and 31 which are modifications of the joints 304 and 314 shown in FIG. 2 for the first embodiment. Each of the joints 30 and 31 is aligned with one of the holes 2*b* of the head holder 2*c*. Each of the joints 30 is connected to a pair of supply tubes 21*a*, 21*b*, 21*c* or 21*d*. Each of the joints 31 is connected to a pair of return tubes 22*a*, 22*b*, 22*c* or 22*d*. The downstream supply tubes 21*a*–21*d* and the upstream return tubes 22*a*–22*d* are connected to the heads 5*a*–5*d*, respectively.

Figure 11:
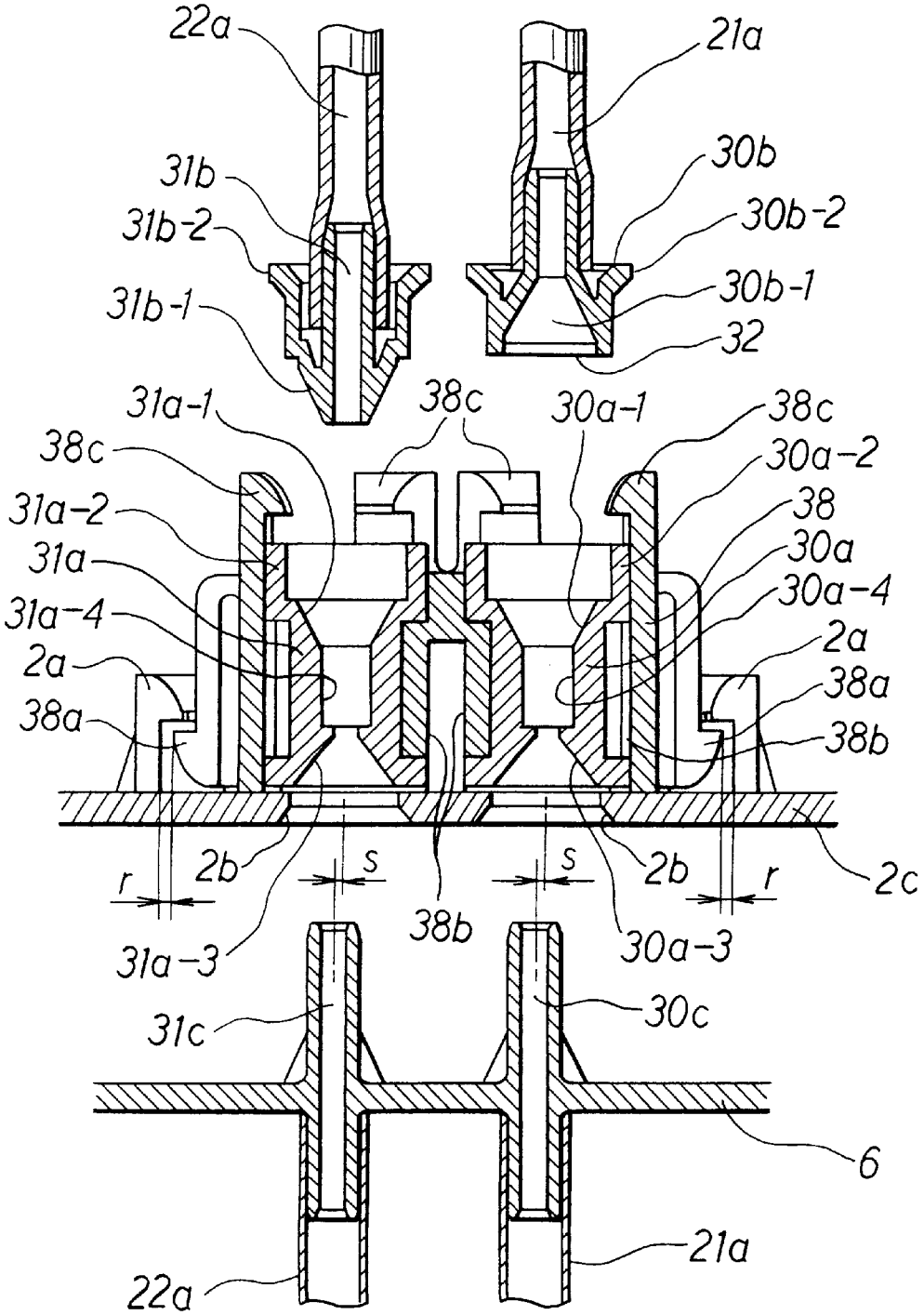
FIG. 11 is a vertical section showing the joints of this supply system.
Figure 12:
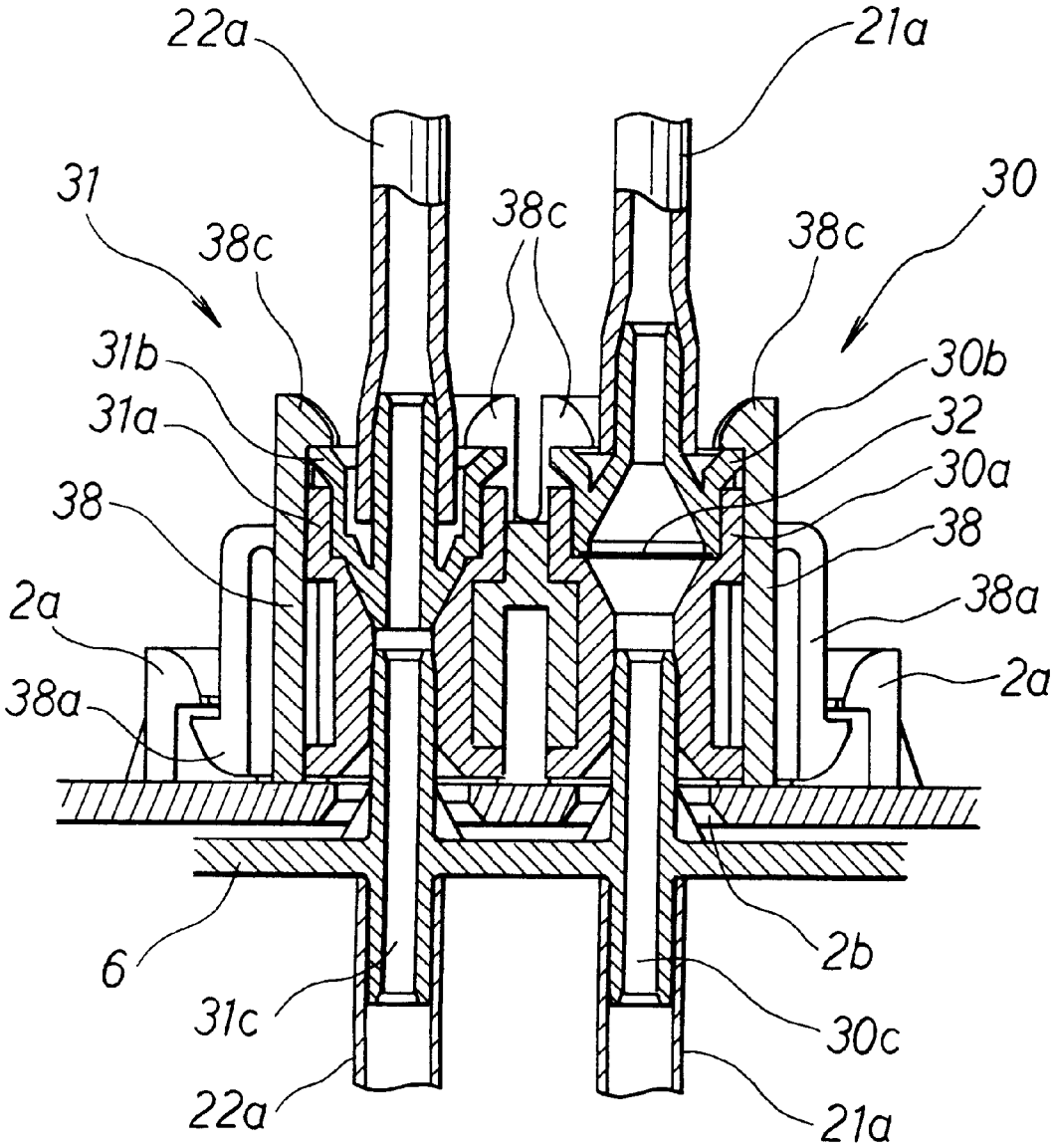
FIG. 12 is a vertical section showing these joints in engaged condition.
Figure 13:
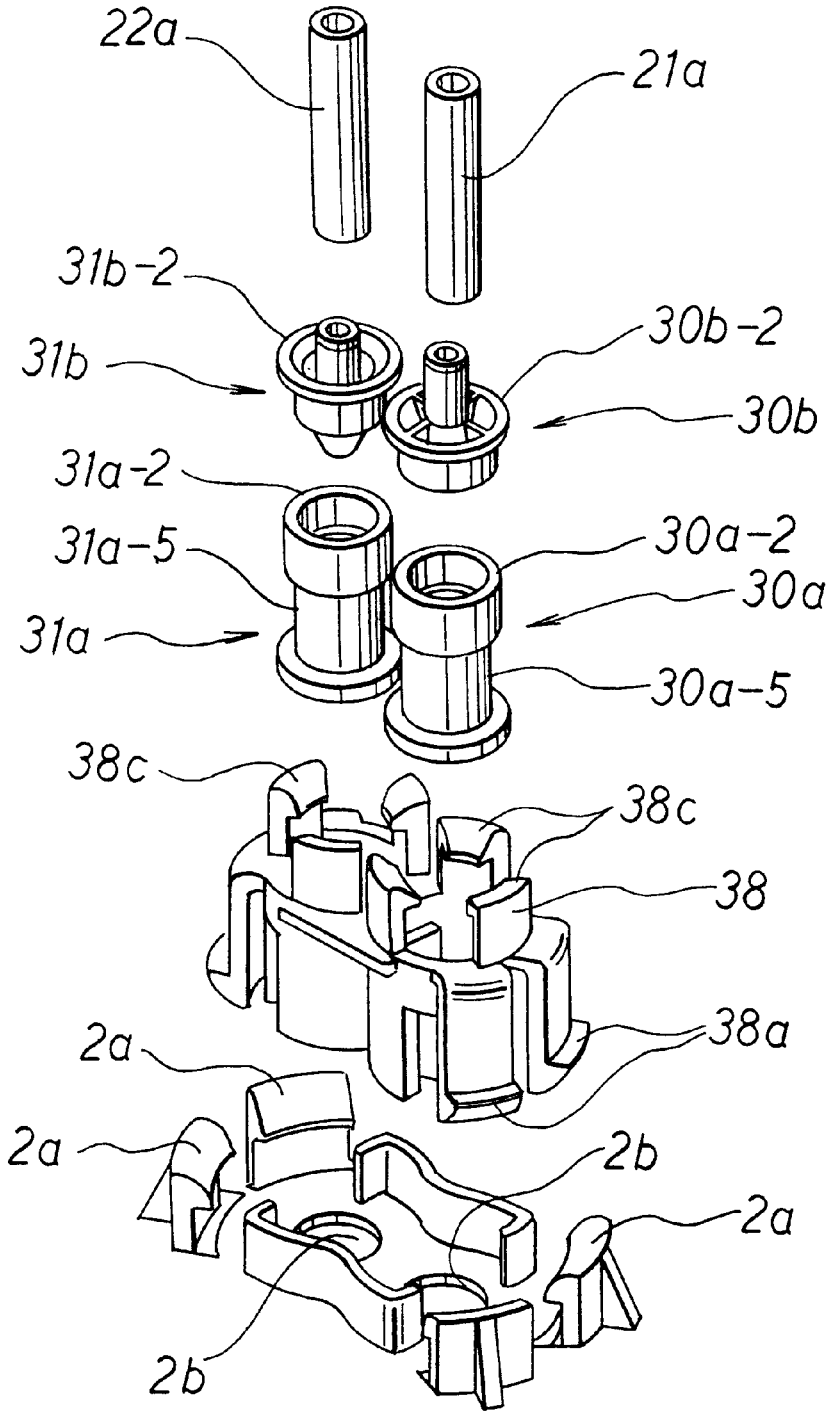
FIG. 13 is an exploded perspective view of these joints etc.

With reference to FIGS. 11–13, each of the joints 30 includes an upper connector 30*b* and a seal member 30*a*, which engage detachable with each other. The top of the connector 30*b* is connected to the associated downstream supply tube 21*a*, 21*b*, 21*c* or 21*d*. The connector 30*b* has a conical bore 30*b*-1 formed near its bottom and widening downward. The seal member 30*a* is cylindrical and may be made of rubber or other elastic material. This member 30*a* has a cylindrical bore 30*a*-2 formed at its top. This member 30*a* also has a conical bore 30*a*-1 widening upward and positioned under the cylindrical bore 30*a*-2. The bottom of the connector 30*b* engages detachable with the cylindrical bore 30*a*-2 of the seal member 30*a*. This engagement causes the bottom of the conical bore 30*b*-1 of the connector 30*b* to face the top of the conical bore 30*a*-1 of the seal member 30*a*. The sealing between the connector 30*b* and the seal member 30*a* is secured between the outer periphery of the bottom of the connector 30*b* and the inner periphery of the cylindrical bore 30*a*-2 of this member.

A filter 32 is supported at the bottom of the connector 30*b* and the top of the conical bore 30*a*-1 of the seal member 30*a* to remove foreign substances etc. from the ink flowing through the filter. The filter 32 may be fixed to one of the connector 30*b* and the seal member 30*a*, or interposed between them. A passage is formed through the connector 30*b* and the seal member 30*a* in mutual engagement. The filter 32 is supported at the position in this passage where the diameter of the passage is largest. This enlarges the contact area between the filter 32 and ink. It is therefore possible to remove foreign substances etc. efficiently from the ink flowing through the filter 32.

The seal member 30*a* has another conical bore 30*a*-3 formed at its bottom and widening downward. This member 30*a* has another cylindrical bore 30*a*-4 formed between the conical bores 30*a*-3 and 30*a*-1. The bores 30*a*-1, 30*a*-2, 30*a*-3 and 30*a*-4 form a passage through the member 30*a*.

The carriage 6 includes lower connectors 30*c* and 31*c* formed on and through it. These connectors 30*c* and 31*c* might otherwise be separate members fixed to the carriage 6. Each of these connectors 30*c* and 31*c* is associated with one of the holes 2*b* of the head holder 2*c*. Each of the connectors 30*c* extends through the associated hole 2*b* and the bottom conical bore 30*a*-3 of the associated seal member 30*a*, and engages detachable in sealed condition with the lower cylindrical bore 30*a*-4 of this member. The bottom of the lower connector 30*c* is connected to the associated upstream supply tube 21*a*, 21*b*, 21*c* or 21*d*.

Each of the other joints 31 includes an upper connector 31*b* and a seal member 31*a*, which engage detachable with each other. The seal member 31*a* is identical with the seal member 30*a*. The top of the upper connector 31*b* is connected to the associated upstream return tube 22*a*, 22*b*, 22*c* or 22*d*. The upper connector 31*b* includes a conical bottom 31*b*-1 narrowing or converging downward for engagement with the upper conical bore 31*a*-1 in the seal member 31*a*. This connector 31*b* also includes an outer cylindrical wall formed over the conical bottom 31*b*-1. This wall engages detachable with the top cylindrical bore 31*a*-2 in the seal member 31*a*. The sealing between the upper connector 31*b* and the seal member 31*a* is secured at one or both of the bores 31*a*-1 and 31*a*-2 in this member.

Similarly to the lower connector 30*c* for the joint 30, each of the lower connectors 31*c* extends through the associated hole 2*b* of the head holder 2*c* and the bottom conical bore 31*a*-3 in the associated seal member 31*a*, and engages detachable in sealed condition with the lower cylindrical bore 31*c*-4 in this member. The bottom of the lower connector 31*c* is connected to the associated downstream return tube 22*a*, 22*b*, 22*c* or 22*d*.

The upper connector 31*b* has a cylindrical bore formed through it, which is substantially equal in diameter to the lower cylindrical bore 31*c*-4 in the seal member 31*a*. Therefore, with this connector 31*b* in engagement with this member 31*a*, no large step is formed between the connector bore and the lower cylindrical bore 31*c*-4. Likewise, the lower connector 31*c* has a cylindrical bore formed through it, which is substantially equal in diameter to the lower cylindrical bore 31*c*-4 in the seal member 31*a*. Therefore, a substantially straight passage is formed through the joint 31.

The upper connectors 30*b* and 31*b* and the seal members 30*a* and 31*a* are fitted to the head holder 2*c* by a joint holder 38. The joint holder 38 includes protrusions 38*b* formed inside it. The seal members 30*a* and 31*a* have outer peripheral grooves or recesses 30*a*-5 and 31*a*-5, respectively, which engage with the protrusions 38*b* to hold these members in parallel. The joint holder 38 also includes pawls 38*c* formed at its top. The upper connectors 30*b* and 31*b* include inverted short skirts 30*b*-2 and 31*b*-2, respectively. With these connectors 30*b* and 31*b* in engagement with the seal members 30*a* and 31*a*, respectively, the skirts 30*b*-2 and 31*b*-2 engage with the pawls 38*c* to hold these connectors. The pawls 38*c* can elastically deform so that the upper connectors 30*b* and 31*b* can engage with the seal members 30*a* and 31*a*.

The joint holder 38 includes hooks 38*a* provided around it. The head holder 2*c* includes pawls 2*a* provided on its bottom plate around every two holes 2*b*. The joint holder 38 is mounted on the head holder 2*c*, with each of the hooks 38*a* engaging with one of the pawls 2*a*. The hooks 38*a* and the pawls 2*a* can elastically deform for mutual engagement. It is possible to mount the joint holder 38 on the head holder 2*c* by moving the joint holder downward until the hooks 38*a* engage with the pawls 2*a*. The engagement of the hooks 38*a* with the pawls 2*a* limits the vertical movement of the joint holder 38.

With the joint holder 38 mounted on the head holder 2*c*, as shown in FIG. 11, there is a little play of "r", between each of the hooks 38*a* and the associated pawl 2*a*. The play of "r"

allows the joint holder 38 to move a little horizontally on the head holder 2*c*.

Back to FIG. 10, the head holder 2*c* includes pins 2*d* extending downward from its bottom plate. The carriage 6 has recesses 6*a* formed in its top plate for each engaging with one of the pins 2*d*.

When the head unit 2 is mounted on the carriage 6, the pins 2*d* engage with the recesses 6*a* to position the head unit 2 relative to the carriage 6. This causes the eight lower connectors 30*c* and 31*c* to pass through the holes 2*b* of the head holder 2*c* and the bottom conical bores 30*a*-3 and 31*a*-3 of the eight seal members 30*a* and 31*a* into engagement with the lower cylindrical bores 30*a*-4 and 31*a*-4 of these members. The seal members 30*a* and 31*a* held by the four joint holders 38 can move horizontally within the range of the play of "r". Therefore, even if there is a displacement or misalignment of "s" between each of the seal members 30*a* and 31*a* and the associated lower connector 30*c* or 31*c*, it can be corrected or compensated. Because the bottom bores 30*a*-3 and 31*a*-3 of the seal members 30*a* and 31*a* are conical, the lower connectors 30*c* and 31*c* can be inserted easily in these members. The engagement of each of the joints 30 and 31 with the associated lower connector 30*c* or 31*c* connects the associated pair of upstream and down stream tubes 21*a*, 21*b*, 21*c*, 21*d*, 22*a*, 22*b*, 22*c* or 22*d*. When the head unit 2 is removed from the carriage 6, it is easy to disconnect each upstream tube and the associated downstream tube.

Thus, the joints 30 and 31 are positioned vertically in such a manner that ink can flow upward through the joints 30 for the supply tubes 21*a*–21*d* and downward through the joints 31 for the return tubes 22*a*–22*d*. This allows air bubbles to pass buoyantly through the filters 32 in the joints 30 together with ink flowing upward. As stated above, no large step is formed between the bore in the upper connector 31*b* of each of the joints 31 and the lower cylindrical bore 31*a*-4 in the associated seal member 31*a*. Therefore, few air bubbles will stay between these bores, and air bubbles can smoothly pass through the joints 31. This always provides wide ink passages, resulting in good recording.

The seal members 30*a* and 31*a* are identical in shape, and can therefore be used in common. This reduces in number the parts forming the joints 30 and 31, and therefore lowers the production costs for the joints.

The joint holders 38 hold the joints 30 and 31 with the play of "r" relative to the head holder 2*c*. Therefore, even if each of the lower connectors 30*c* and 31*c* is not aligned slightly with the associated seal member 30*a* or 31*a* (displacement of "s") when the head unit 2 is mounted on the carriage 6, the associated joint 30 or 31 can be positioned within the range of the play of "r". This makes it easy to connect each of the lower connectors 30*c* and 31*c* to the associated seal member 30*a* or 31*a* even if they are displaced slightly from each other when the head unit 2 is mounted on the carriage 6.

With each of the upper connectors 30*b* in engagement with the associated seal member 30*a*, the conical bore 30*b*-1 of the upper connector and the upper conical bore 30*a*-1 of the seal member widen toward the associated filter 32. This allows ink to flow properly to the filter 32, and therefore no special part is necessary for introducing ink to the filter 32. Consequently, the parts forming each of the joints 30 are reduced in number, and it is therefore possible to simplify the process for assembling or engaging the parts of the joints 30. It is also possible to downsize the joints 30.

As will be apparent from the comparison between the prior art shown in FIGS. 28 and 29 and a tenth embodiment of the invention, which will be described later, there are few spaces or regions in each of the joints 30 where air bubbles tend to stay, because the bottom of the associated upper connector 30*b* is connected to the top of the top conical bore 30*a*-1 in the associated seal member 30*a*. Therefore, few air bubbles impede the ink flow through the joint 30.

Figure 14:
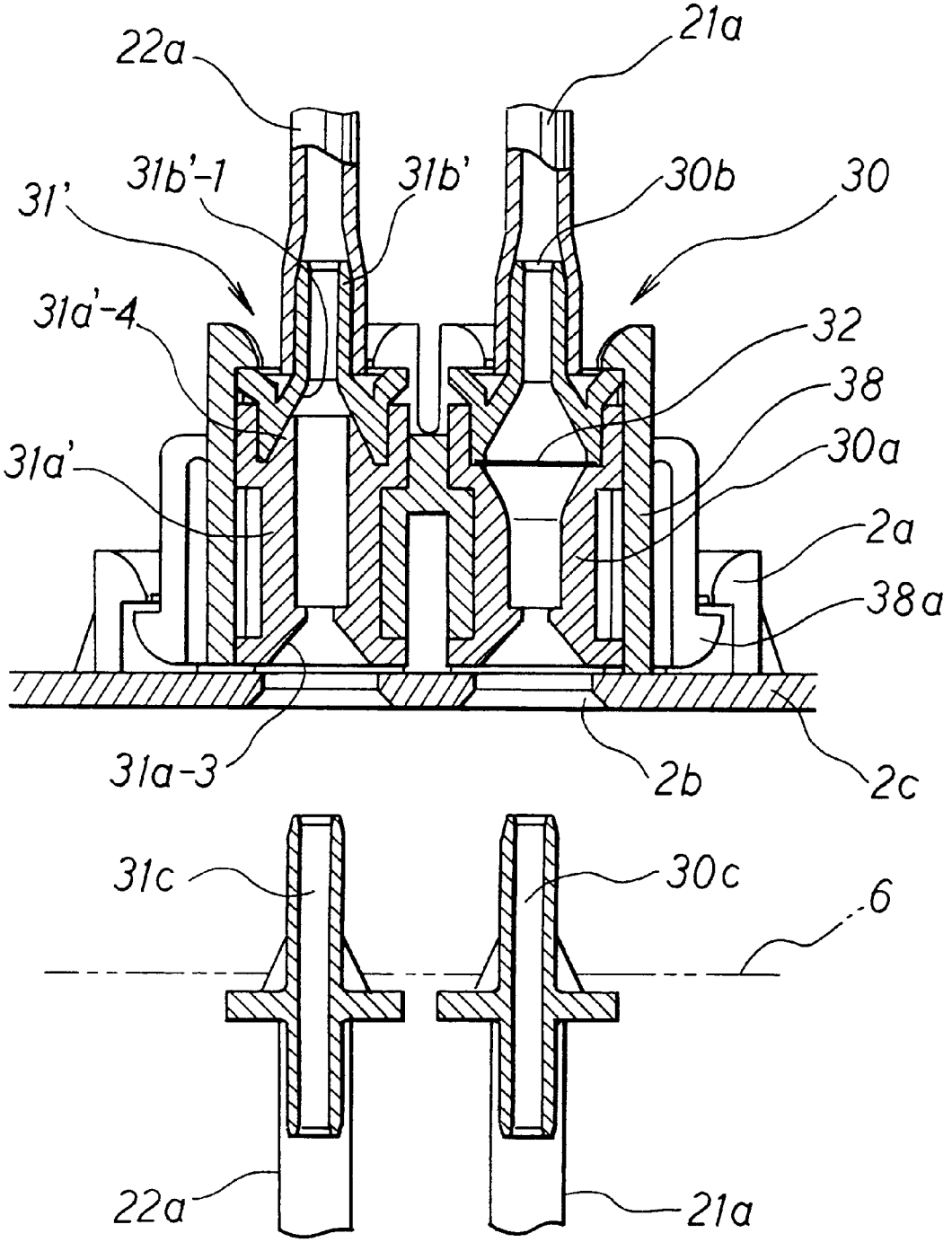
FIG. 14 is a vertical section showing joints according to a fifth embodiment of the invention.
Figure 15:
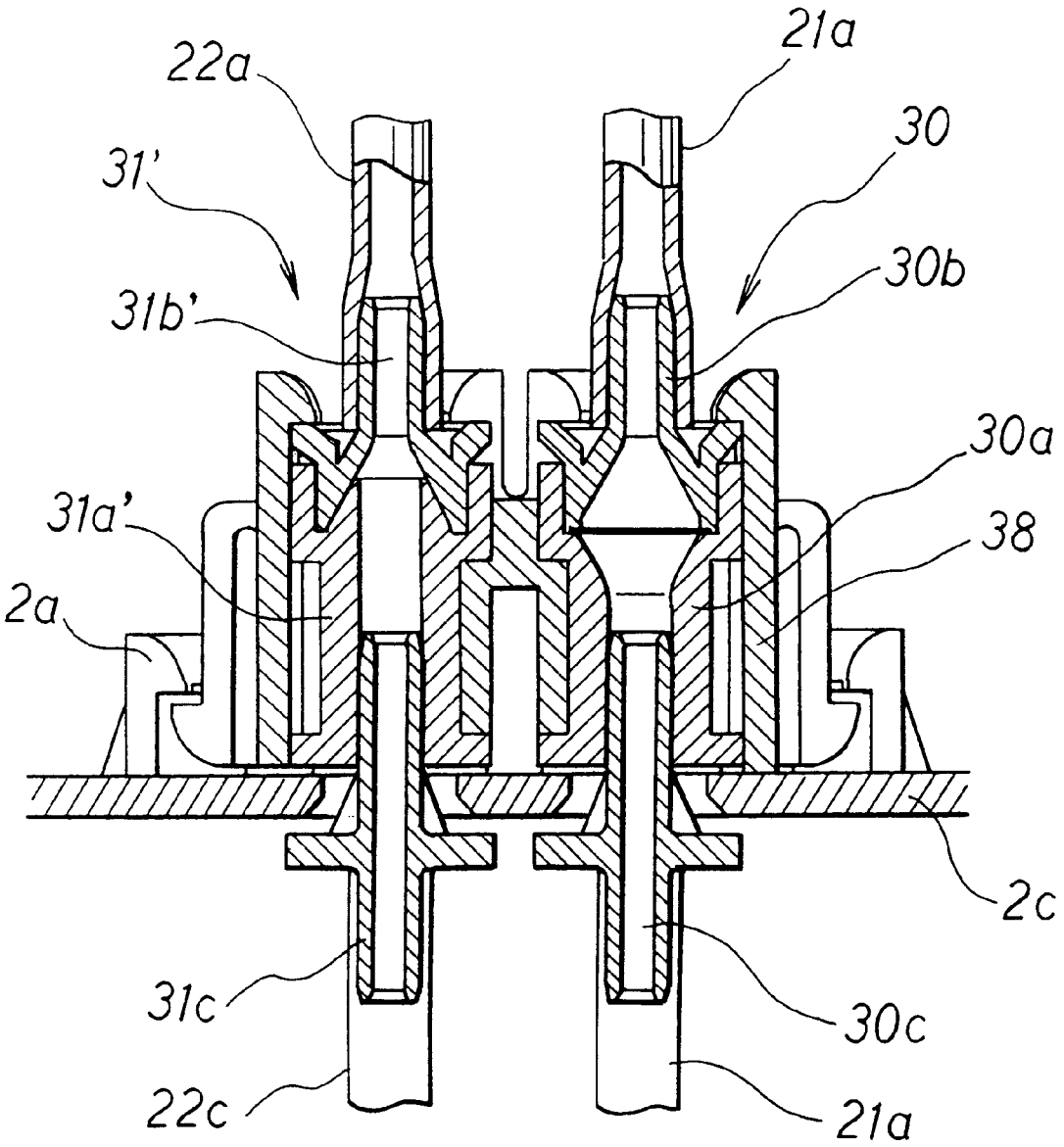
FIG. 15 is a vertical section showing these joints in engaged condition.

FIGS. 14 and 15 show joints 30' and 31' according to a fifth embodiment of the invention. The joints 30' for supply tubes 21*a*, 21*b*, 21*c* or 21*d* (only 21*a* shown) are identical with the joints 30 according to the fourth embodiment. Each of the joints 31' for return tubes 22*a*, 22*b*, 22*c* or 22*d* (only 22*a* shown) includes an upper connector 31*b*', which is identical with the upper connectors 30*b* of the joints 30.

The joint 31' also includes a seal member 31*a*', which has a conical head 31*a*'-4 narrowing upward for compressive contact with the side of the conical bore 31*b*'-1 in the upper connector 31*b*'. The seal member 31*a*' also has a cylindrical bore extending through the head 31*a*'-4. This member 31*a*' further has a bottom conical bore 31*a*-3 formed under the cylindrical bore and widening downward.

The other parts of the joints 30' and 31' are substantially identical to the counterparts of the joints 30 and 31 according to the fourth embodiment.

There is no step where air bubbles tend to stay between the upper connector 31*b*' and the seal member 31*a*'.

Figure 16:
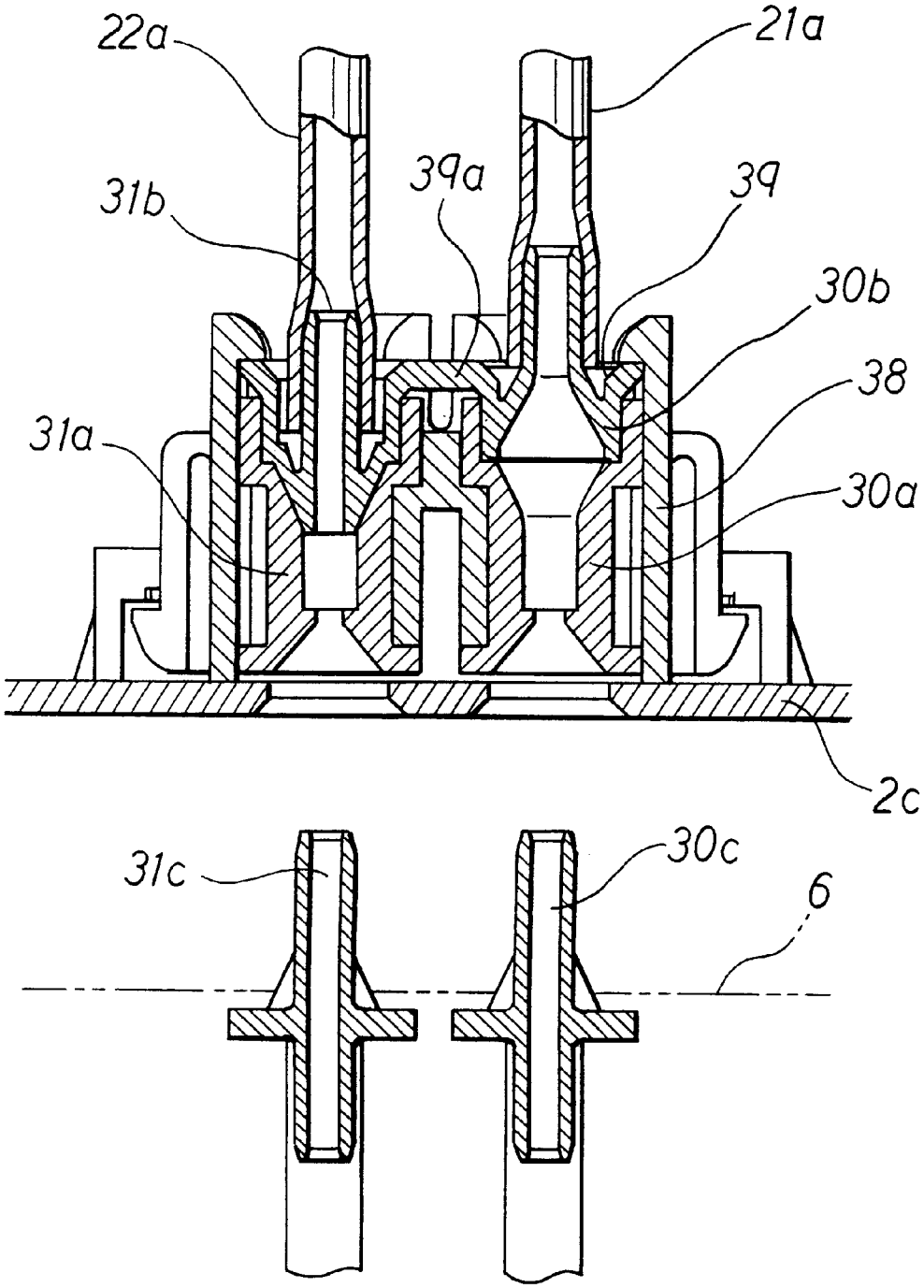
FIG. 16 is a vertical section showing joints according to a sixth embodiment of the invention.

FIG. 16 shows joints according to a sixth embodiment of the invention. These joints include a double connector 39, which includes a pair of integral upper connectors. The connectors are connected by a bridge 39*a*, and identical with the upper connectors 30*b* and 31*b* of the joints 30 and 31 according to the fourth embodiment. The other parts of these joints are substantially identical with the counterparts of the joints 30 and 31. This may be applied likewise to the joints according to the fifth embodiment. The double connector 39 reduces the number of steps for fitting the joints to a joint holder 38, and improves the productivity of the joints.

The foregoing embodiments may be modified in various ways. The conical bores in the seal members 30*a* and 31*a* and the upper connectors 30*b* and 31*b* widen outward, but might be shaped otherwise to guide ink smoothly. The filter 32 in each of the joints 30 might otherwise be fitted in the associated joint 31 for the associated return tubes 22*a*, 22*b*, 22*c* or 22*d* (only 22*a* shown). In this case, the joints 30 for the supply tubes 21*a*–21*d* (only 21*a* shown) might each have a straight passage formed through it.

Figure 17:
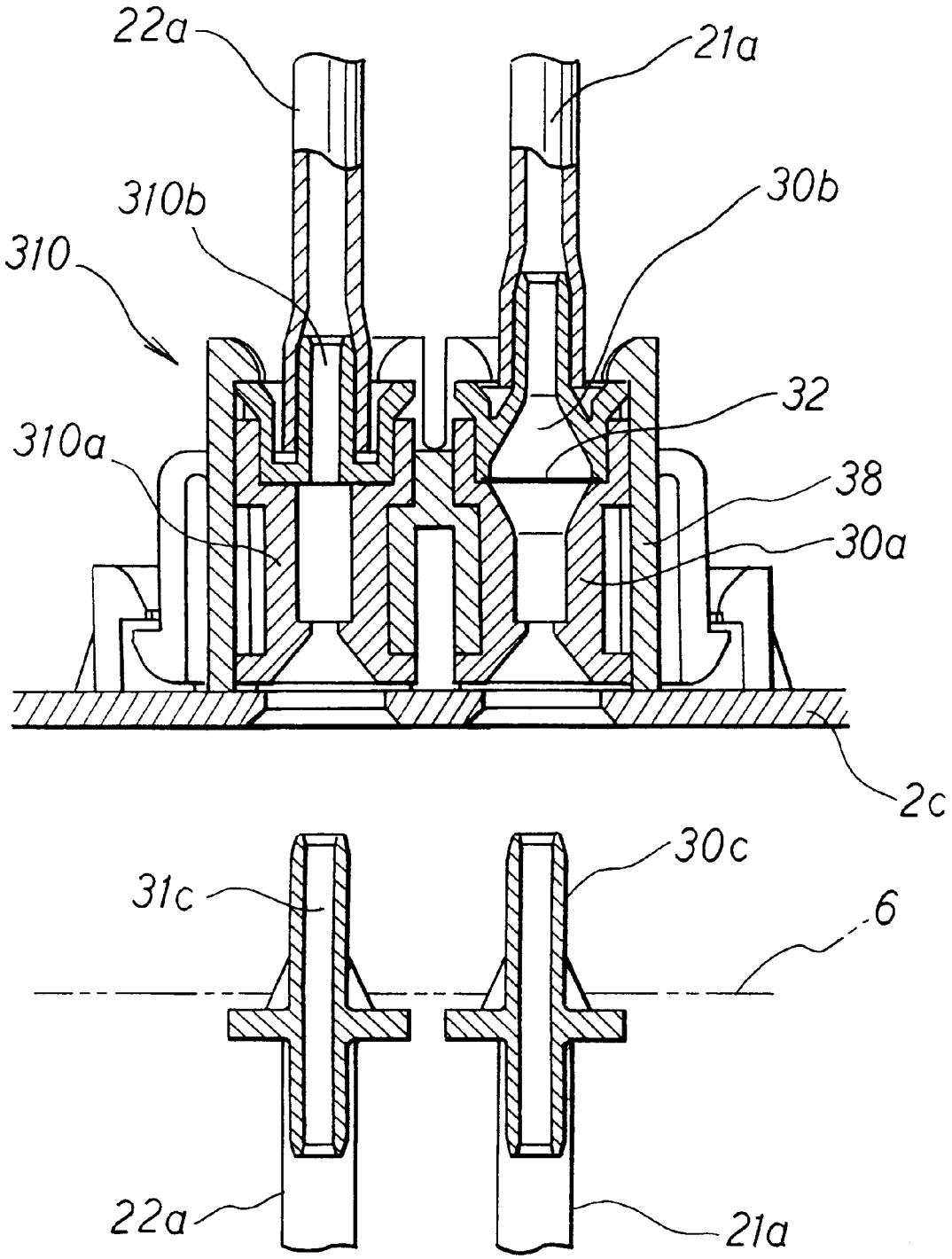
FIG. 17 is a vertical section showing joints according to a seventh embodiment of the invention.
Figure 18:
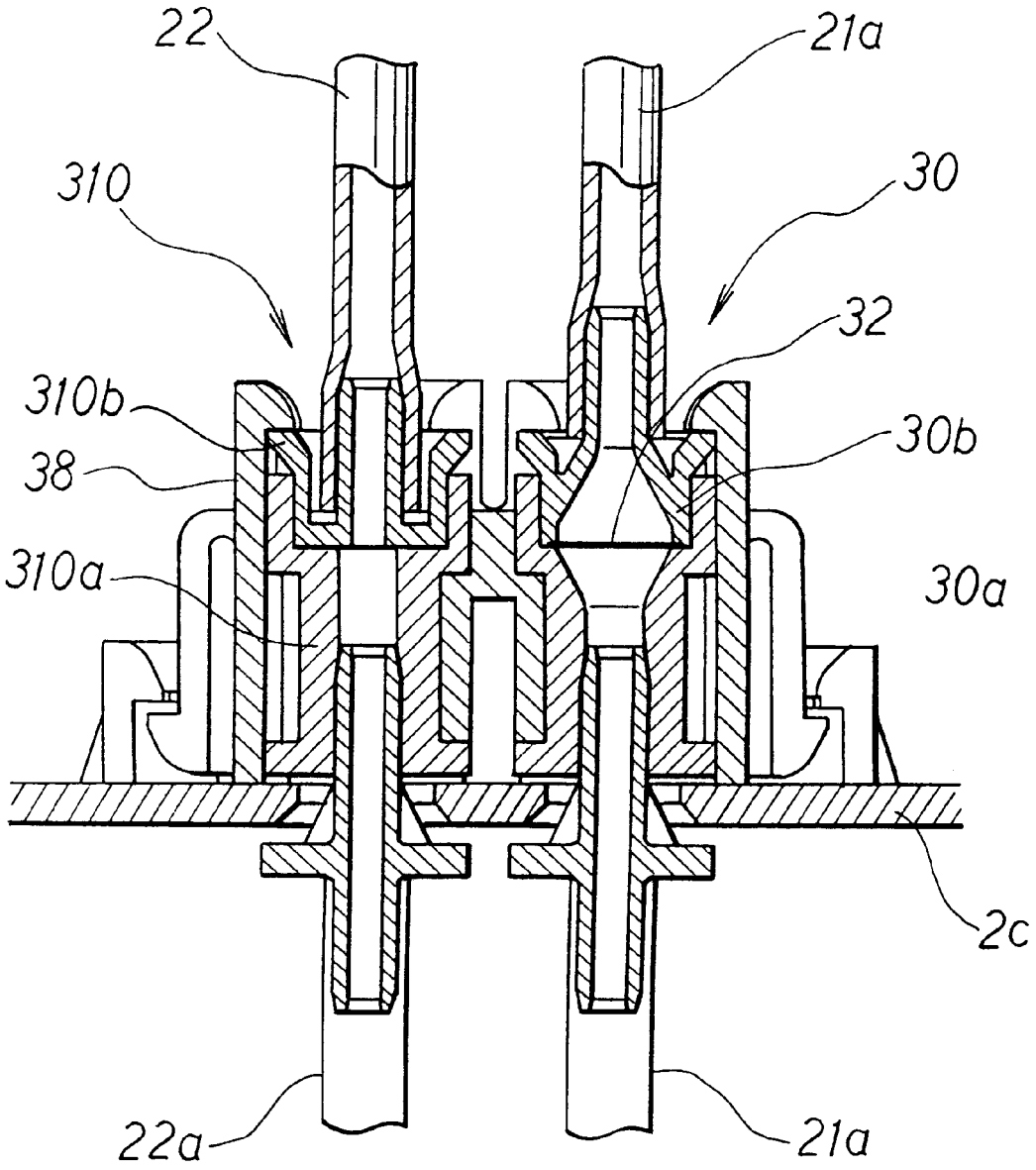
FIG. 18 is a vertical section showing these joints in engaged condition.

FIGS. 17 and 18 show joints 30 and 310 according to a seventh embodiment of the invention. The joint 310 for a pair of return tubes 22*a*, 22*b*, 22*c* or 22*d* (only 22*a* shown) includes a seal member 310*a* and an upper connector 310*b*, each of which has a cylindrical bore formed in it. The other parts of the joints 30 and 310 are substantially identical with the counterparts of the joints according to the fourth embodiment. It is not possible to use the seal members and the upper connectors in common to the joints 30 and 310, as is the case with the fourth or fifth embodiment. The seventh embodiment is equivalent to the fourth and fifth embodiments, however, in that air bubbles can pass buoyantly through the filter 32 in the joint 30 together with ink flowing upward. This embodiment is also equivalent to those embodiments in that, because no large steps are formed between the upper connector 310*b* and the inner surfaces of the seal member 310*a* of the joint 310, few air bubbles tend to stay there.

Figure 19:
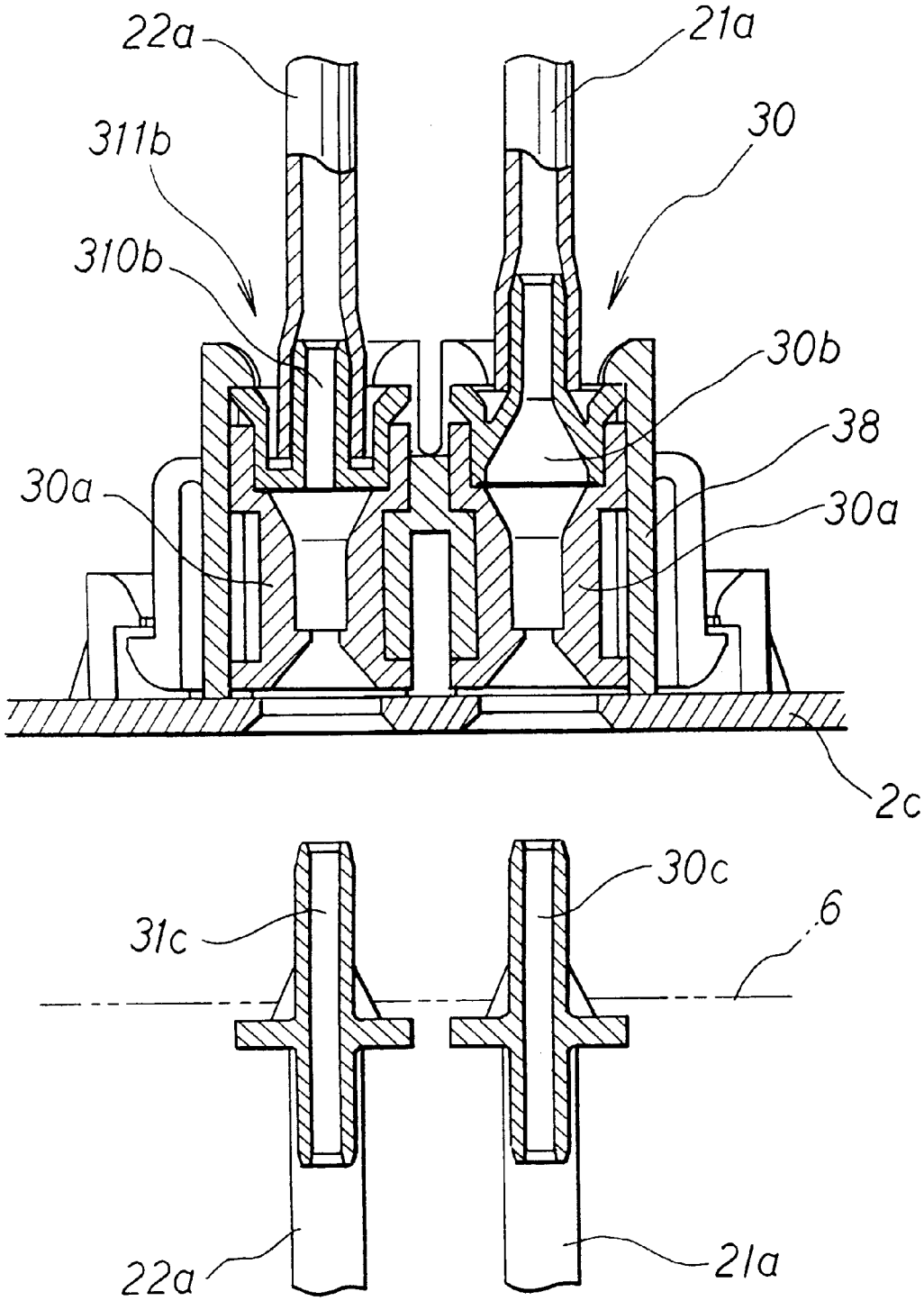
FIG. 19 is a vertical section showing joints according to an eighth embodiment of the invention.
Figure 20:
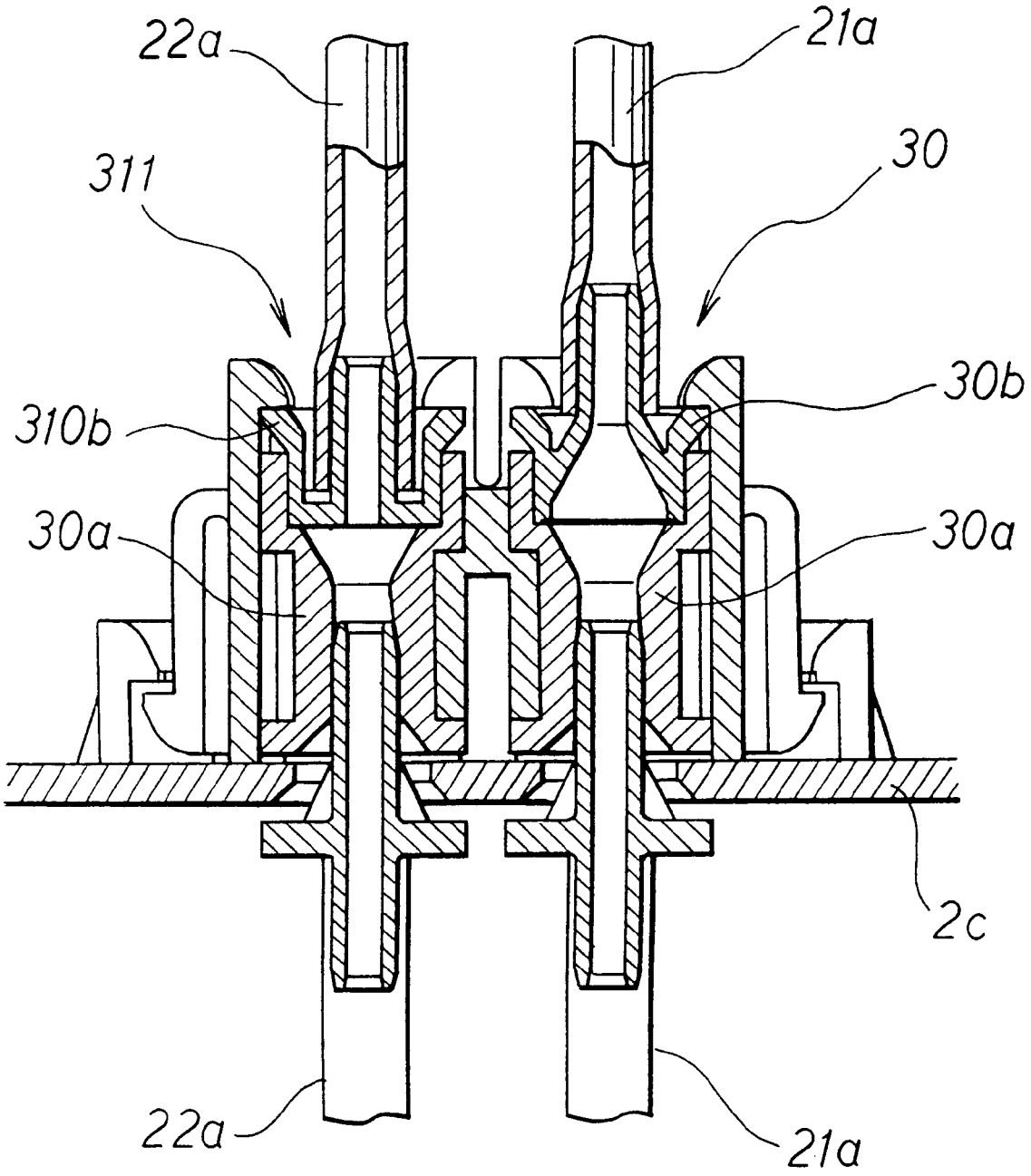
FIG. 20 is a vertical section showing these joints in engaged condition.

FIGS. 19 and 20 show joints 30 and 311 according to an eighth embodiment of the invention. The joints 30 and 311 include identical seal members 30*a*. The joint 311 for a pair of return tubes 22*a*, 22*b*, 22*c* or 22*d* includes an upper connector 310*b*, which has a cylindrical bore formed in it, as is the case with the sixth embodiment. The other parts of the joints 30 and 311 are substantially identical with the counterparts of the fourth embodiment. The seal members 30*a* can be used in common to the joints 30 and 311. In the joint 311, however, a large step is formed between the upper connector 310*b* and an inner surface of the seal member 30*a*. In this respect, the fourth and fifth embodiments are preferable.

Figure 21:
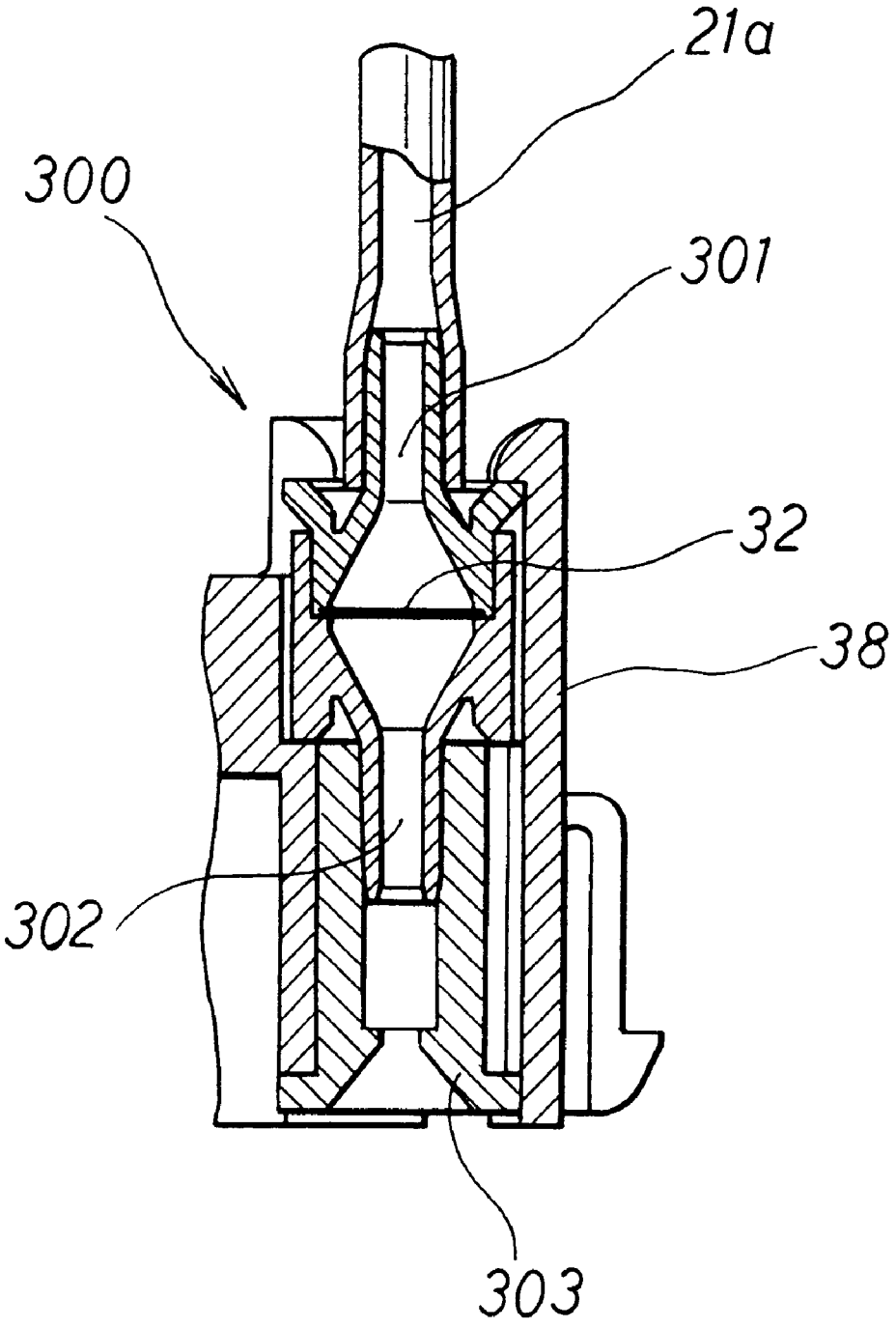
FIG. 21 is a vertical section showing a joint according to a ninth embodiment of the invention.

FIG. 21 shows the joint 300 for each pair of supply tubes 21*a*, 21*b*, 21*c* or 21*d*, only the downstream tube 21*a* of which is shown, of an ink supply system according to a ninth embodiment of the invention. The joint 300 includes an upper connector 301, a lower connector 302 and a seal member 303. The upper connector 301 is connected to the associated downstream supply tube 21*a*, 21*b*, 21*c* or 21*d*, and is fitted with a filter 32. The upper connector 301 engages with the lower connector 302, which engages with the seal member 303. The upper connector 301 has a conical bore widening downward. The lower connector 302 has a conical bore widening upward. As is the case with the foregoing embodiments, the bottom of the seal member 303 engages with another connector (not shown), which is connected to the associated upstream supply tube. This upstream tube is connected to a sub tank. The lower connector 302 serves to introduce to the filter 32 the ink flowing from the tank. Air bubbles can pass buoyantly through the filter 32 together with ink flowing upward. In this respect, this embodiment and the foregoing embodiments are similar.

Figure 22:
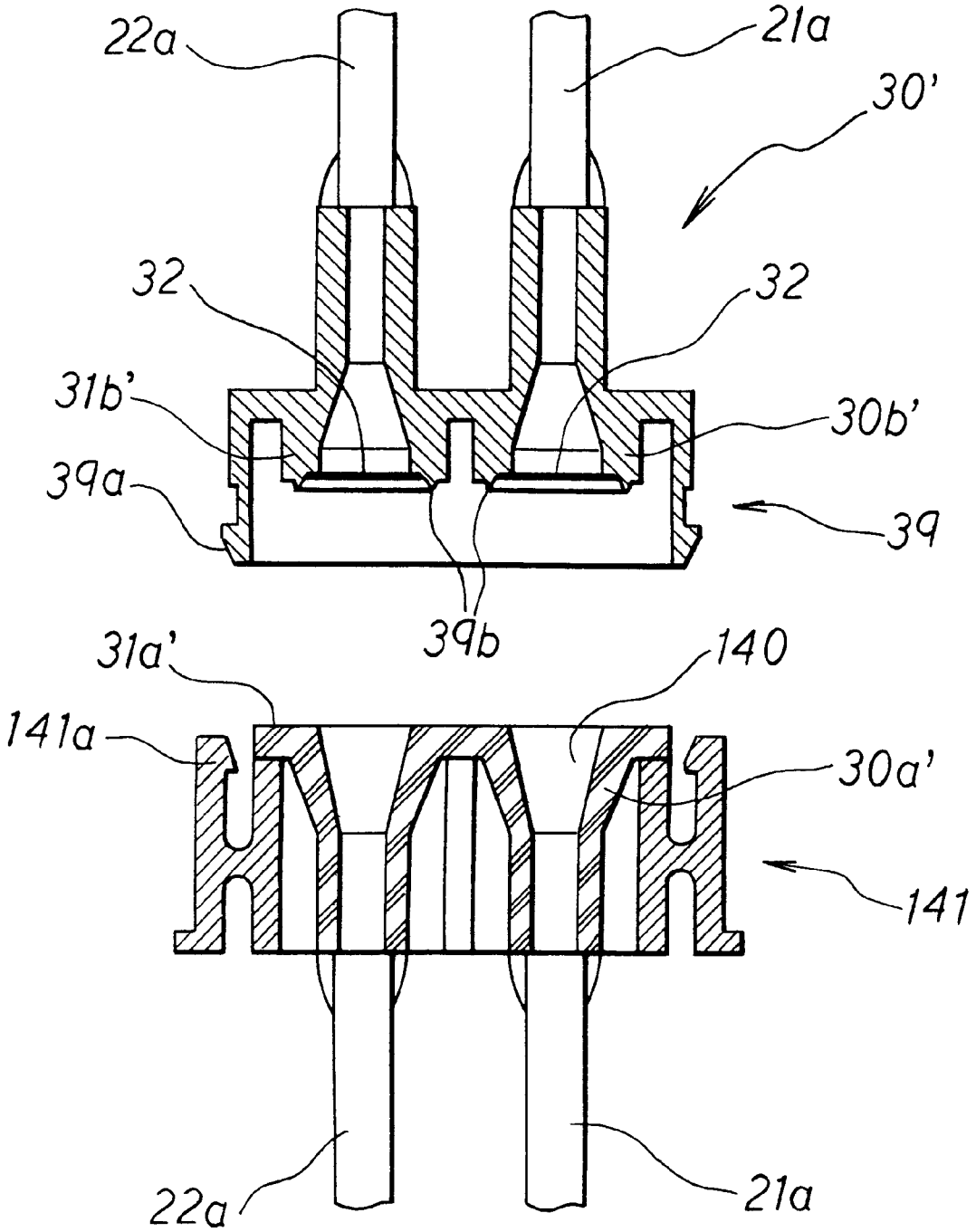
FIG. 22 is a vertical section showing a joint according to a tenth embodiment of the invention.
Figure 23:
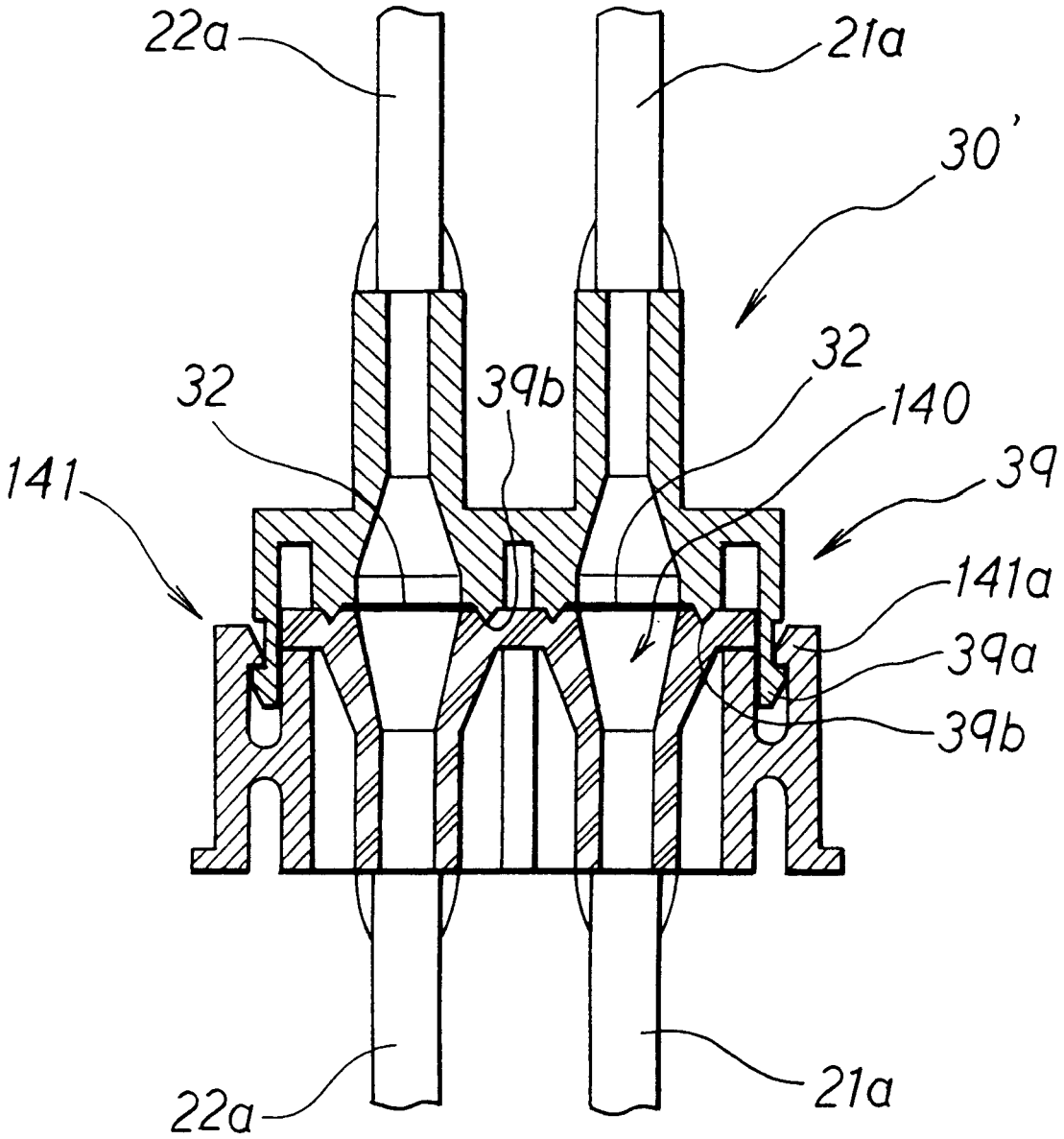
FIG. 23 is a vertical section showing the joint of the tenth embodiment in engaged condition.
Figure 28:
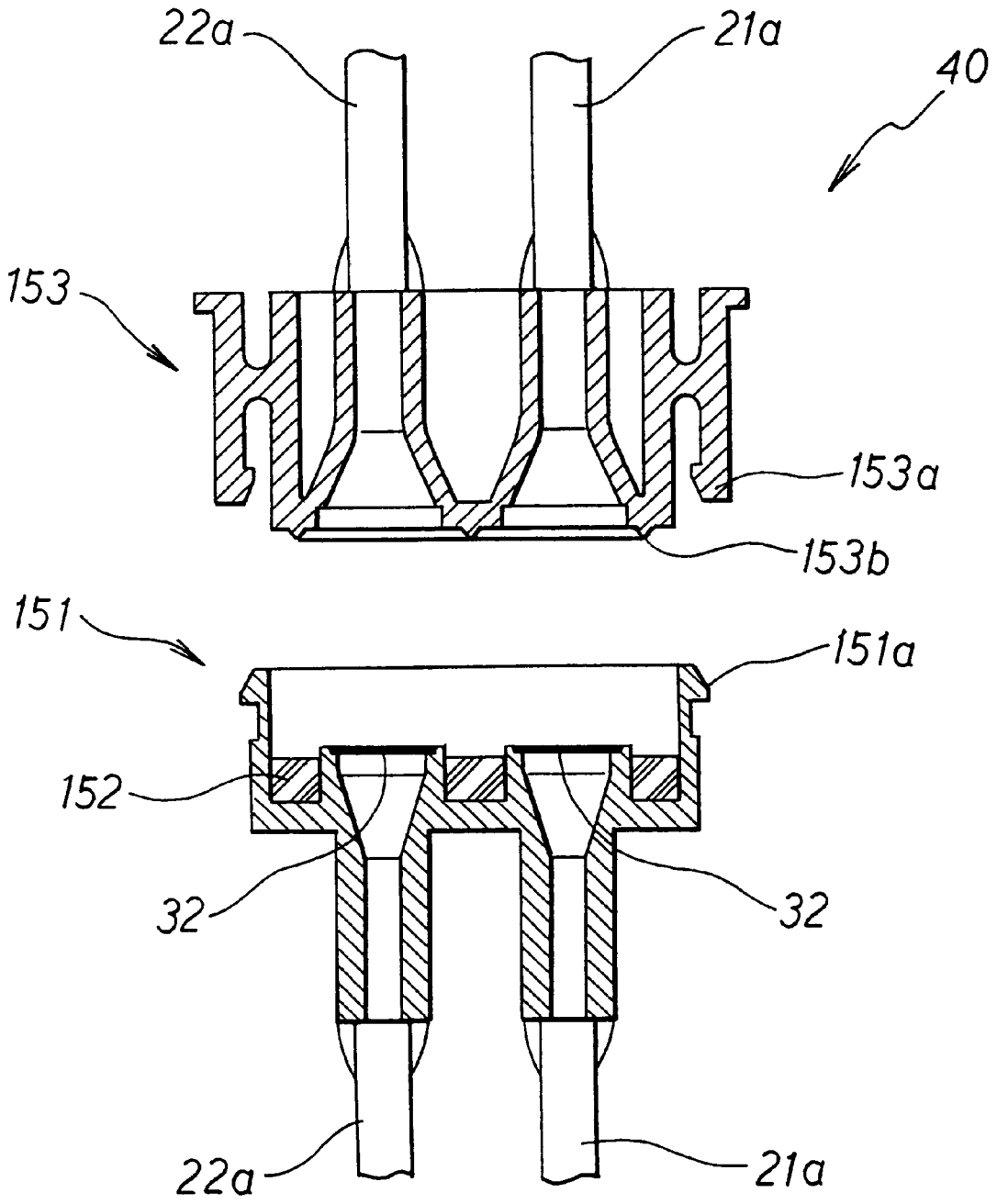
Fig. 28 (PRIOR ART)
FIG. 28 is a vertical section showing the joint of this supply system.
Figure 29:
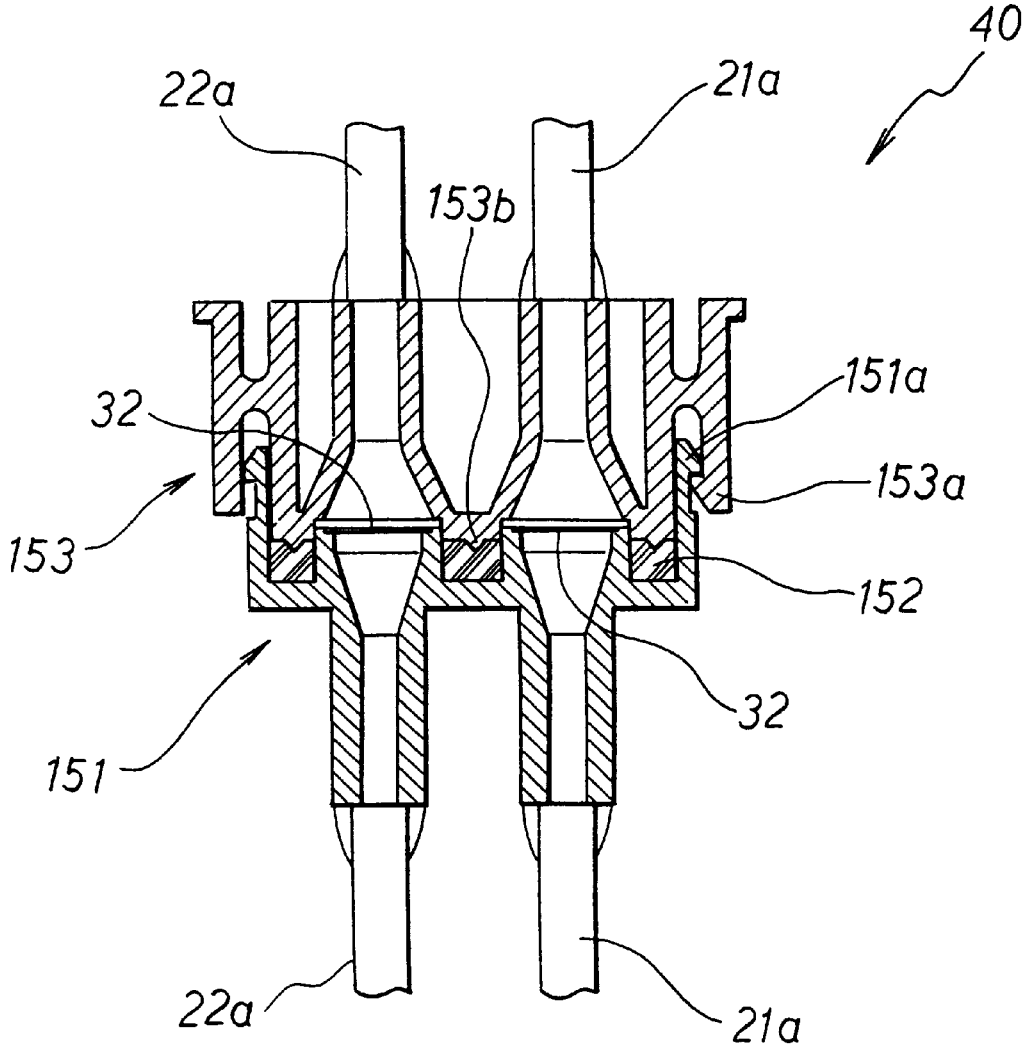
Fig. 29 (PRIOR ART)
FIG. 29 is a vertical section showing this joint in engaged condition.

FIGS. 22 and 23 show a joint 30' according to the tenth embodiment of the invention for solving the problem of the structure shown in FIGS. 28 and 29. The joint 30' includes a double connector 39, which includes integral twin connectors 30*b*' and 31*b*'. The connectors 30*b*' and 31*b*' are connected to the downstream supply tube 21*a* and the upstream return tube 22*a*, respectively. Each of the connectors 30*b*' and 31*b*' is fitted with a filter 32 on its bottom. The double connector 39 engages with a double seal member 140, which includes integral twin sealers 30*a*' and 31*a*'. The sealers 30*a*' and 31*a*' are connected directly to the upstream supply tube 21*a* and the downstream return tube 22*a*, respectively. The seal member 140 is held by a holder 141, which is mounted on a carriage (not shown). The double connector 39 also includes lock pawls 39*a*. The holder 141 includes lock pawls 141*a* for each engaging with one of the pawls 39*a*. Each of the twin connectors 30*b*' and 31*b*' includes a ridge 39*b* formed on its bottom. The ridge 39*b* engages with the top of the associated sealer 30*a*' or 31*a*' in such a manner that the sealer top deforms for effective sealing.

The double connector 39 and the double seal member 140 are connected end to end. This connection is held by the engagement of the lock pawls 39*a* and 141*a*. With the connector 39 and the seal member 140 connected to each other, the top of the seal member deforms in accordance with the shape of the ridges 39*b* of the connector. This makes effective seals very near to the passages formed through the connector 39 and the seal member 140, and to the filters 32 fitted to the connector. Therefore, few gaps are liable to be formed between each ridge 39*b* and the associated passages and filter 32. Consequently, fewer air bubbles may stay in the passages. Because the seal member 140 is connected directly to the upstream supply tube 21*a* and the downstream return tube 22*a*, the number of parts of the joint 30' decreases.

Figure 24:
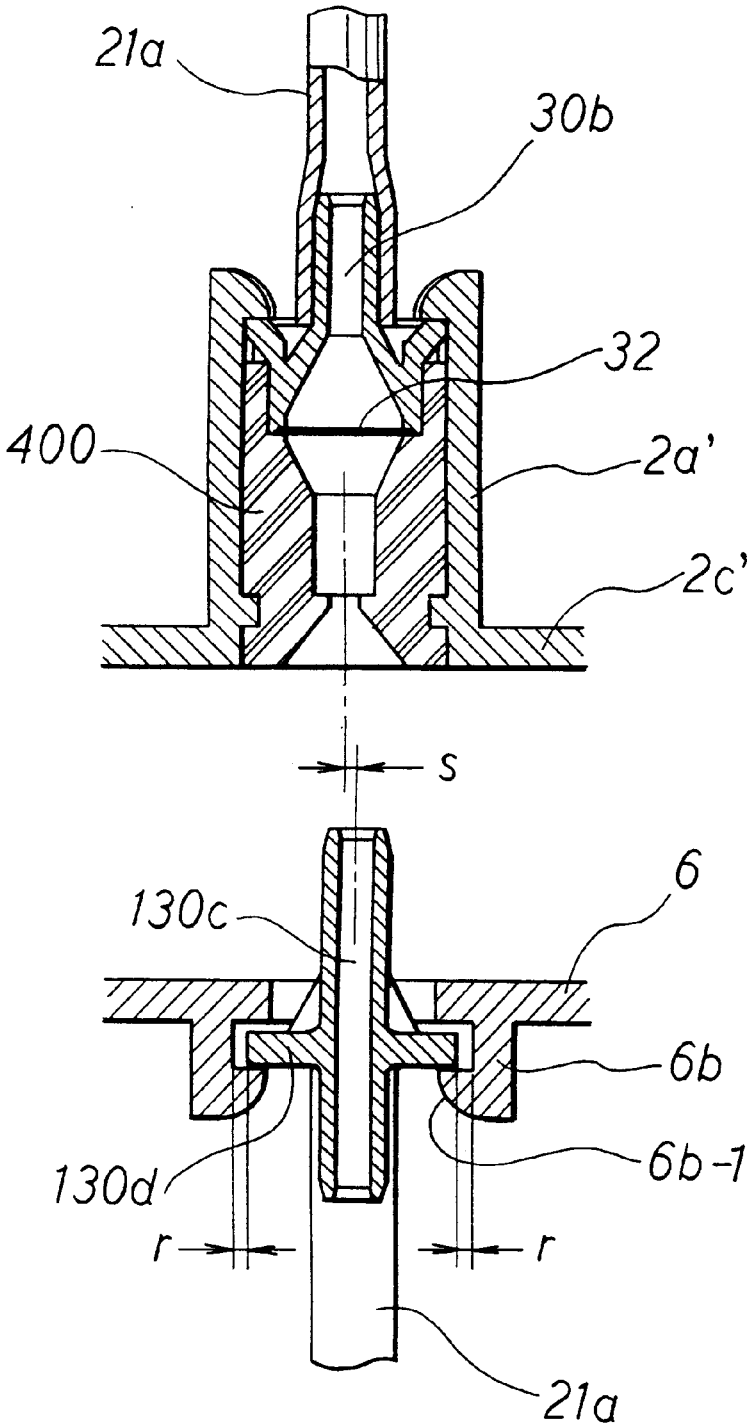
FIG. 24 is a vertical section showing a joint according to an eleventh embodiment of the invention.
Figure 25:
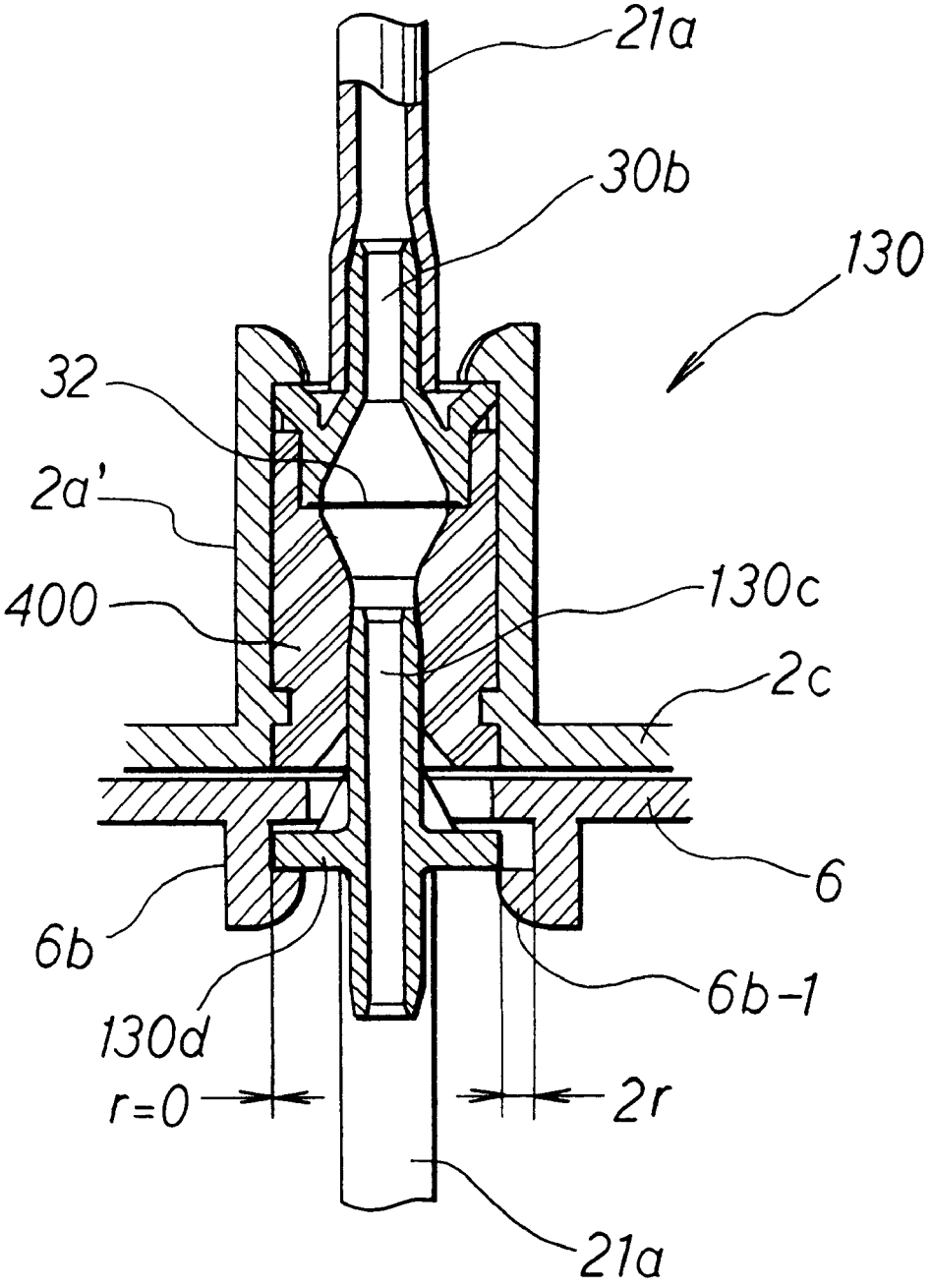
FIG. 25 is a vertical section showing the joint of the eleventh embodiment in engaged condition.

FIGS. 24 and 25 show the joint 130 for each pair of supply tubes 21*a*, 21*b*, 21*c* or 21*d* (only 21*a* shown) of the ink supply system of an ink jet recorder according to an eleventh embodiment of the invention. The recorder includes a head holder 2*c*', which can be mounted on a carriage 6.

The head holder 2*c*' includes cylindrical holders 2*a*, standing on it. The joint 130 includes an upper connector 30*b* and a seal member 400, which are fixed directly to one of the cylindrical holders 2*a'*.

The carriage 6 includes cylindrical holders 6*b* protruding downward from it for each holding a lower connector 130*c*. Each of these holders 6*b* includes an inner flange 6*b*-1 formed on it. The lower connector 130*c* includes an outer flange 130*d* formed on it. The cylindrical holder 6*b* surrounds the associated outer flange 130*d*, which engages with the inner flange 6*b*-1 to keep the lower connector 130*c* from falling down. The inner flange 6*b*-1 can elastically deform so that the lower connector 130*c* can engage with and disengage from the cylindrical holder 6*b*. The outer flange 130*d* engages with the cylindrical holder 6*b* with a little horizontal play of "r" around this flange. Thus, as shown in FIG. 25, the lower connector 130*c* is fitted to the carriage 6 with the horizontal play of 2*r*.

When the head holder 2*c*' is mounted on the carriage 6, there may be a displacement of "s" between the seal member 400 and the lower connector 130*c*. Even in this case, because the lower connector 130*c* can move horizontally within the range of 2*r* relative to the carriage 6, it is possible to engage this connector and the seal member 400 accurately. Thus, because the position of the lower connector 130*c* can be varied within this range relative to the carriage 6, it is easy to engage this connector and the seal member 400 when the head holder 2*c*' is mounted on the carriage 6.

In place of the lower connector 130*c* being movable relative to the carriage 6, the upper connector 30*b* could move horizontally relative to the head holder 2*c'*.

The structure of the cylindrical holder 6*b* on the carriage 6 and the outer flange 130*d* on the lower connector 130*c* might be applied to the head holder 2*c*' and the upper connector 30*b*, respectively.

The invention is not limited to the foregoing embodiments, which may be modified in various ways.

For example, each or one of the joint 30 or 130 for the supply tubes 21*a* and the joint 31 for the return tubes 22*a* might be fitted with a little play to the head holder 2*c* or the carriage 6.

Figure 26:
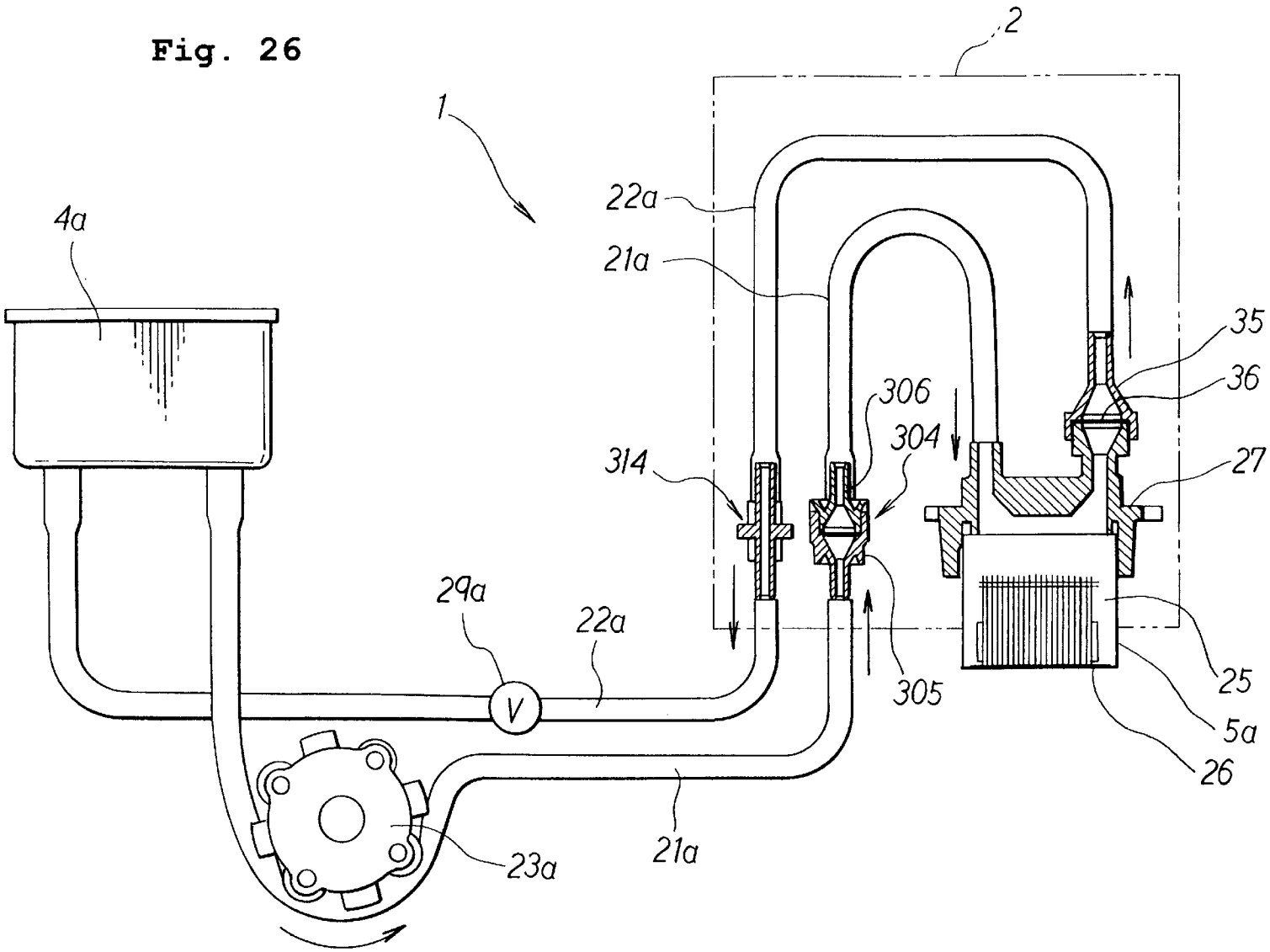
FIG. 26 is a schematic view showing the ink supply system for one of the recording heads of an ink jet recorder according to another embodiment of the invention.
Figure 27:
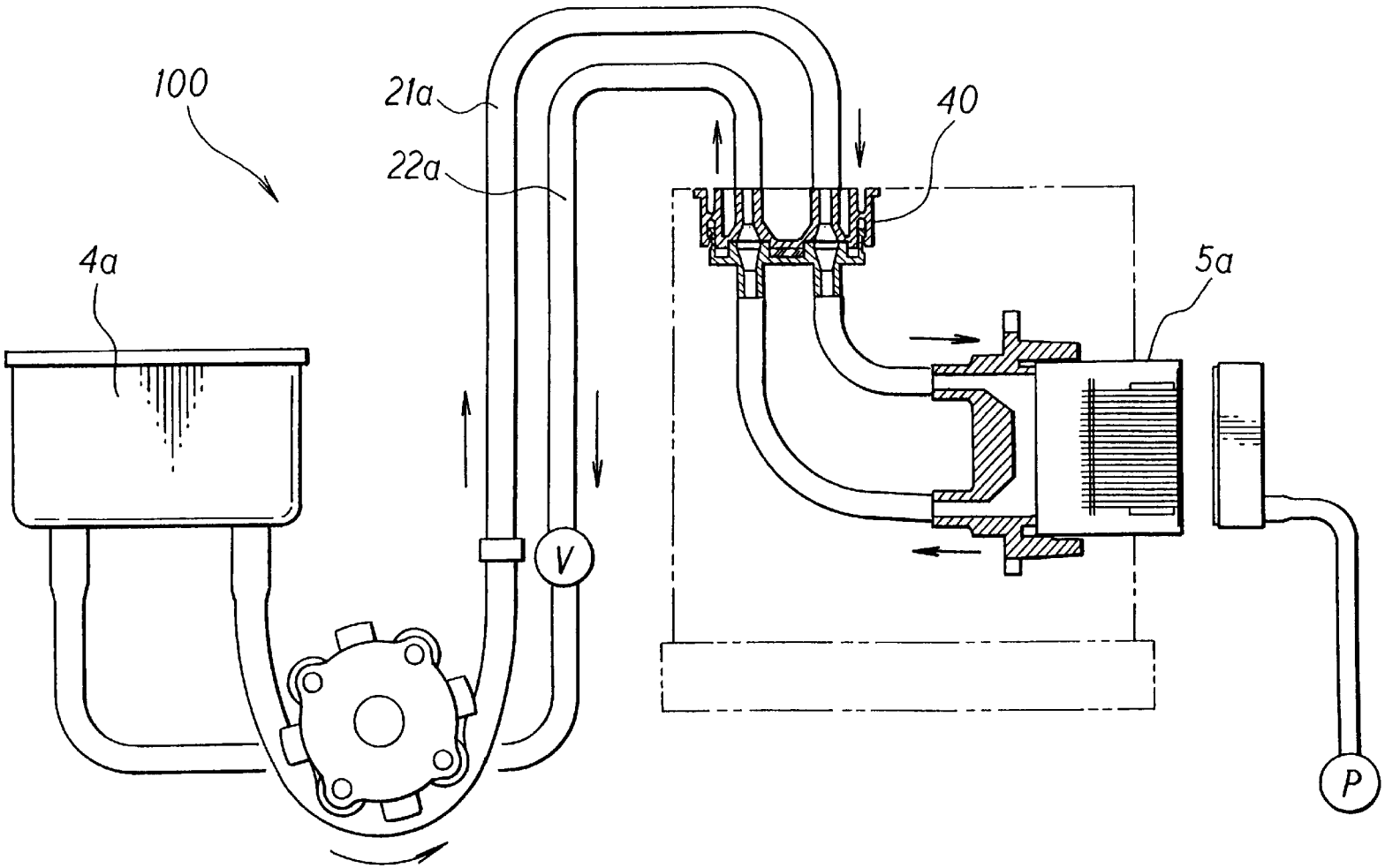
Fig. 27 (PRIOR ART)
FIG. 27 is a schematic view showing the ink supply system of a conventional ink jet recorder.

As shown in FIG. 2, the recording heads 5*a*–5*d* (only 5*a* shown) according to the first embodiment are so positioned as to eject ink horizontally. As shown in FIG. 26, however, the heads 5*a*–5*d* might be so positioned as to eject ink downward. With reference to FIG. 26, ink can flow upward through the filters 32 and 36. This prevents the filters 32 and 36 effectively from trapping air bubbles.

In each of FIGS. 2 and 26, the filter 36 is fitted in the connector 35, which engages with the manifold 27 of the recording head 5*a*. Otherwise, the upstream return tube 22*a* might be bent properly to have a part where ink can flow upward. This tube part is fitted with a joint including a filter.

What is claimed is:

1. An ink jet recorder, comprising:

A tank for storing ink;

an ink jet head for ejection the ink onto a recording medium;

an ink tube for connecting the tank and the head, a part of the ink tube being formed such that the ink flows upward, the ink tube including a supply tube for supplying the ink from the tank to the head and a return tube for returning the ink from the head to the tank; and an ink filter for removing foreign substances from the ink, the ink filter fitted in the part of the ink tube, such that ink flowing from the tank to the ink jet head travels upwardly through the ink filter, the ink filter including a first filter and a second filter, the part of the ink tube including a part of the supply tube formed such that the ink flows upward and the first filter fitted in the part of the supply tube, the part of the ink tube further including a part of the return tube formed such that the ink flows upward and the second filter fitted in the part of the return tube.

2. An ink jet recorder according to claim 1, and further comprising:

a carriage for mounting the ink jet head thereon and moving the head over the recording medium; and a first joint fitted in the part of the supply tube, the first joint having a passage formed therein, the passage communicating with the supply tube, the first filter being fitted in the passage.

3. An ink jet recorder according to claim 2, wherein the return tube is connected to the ink jet head at the part of the return tube, the recorder further comprising a second joint fitted in the part of the return tube, the second joint having a passage formed therein, the second filter being fitted in the passage of the second joint.

4. An ink jet recorder according to claim 1, wherein a part of the supply tube being formed such that the ink flows upward, a part of the return tube being formed such that the ink flows upward, the recorder further comprising an integral joint fitted in the parts of the supply and return tubes, the joint having a first passage and a second passage formed therein, the first and second passages communicating with the supply and return tubes, respectively, the filter being a plane filter crossing the passages, the filter being positioned in the joint in such a manner that the ink flowing through the passages moves obliquely through the filter.

5. An ink jet recorder according to claim 4, wherein the first and second passages are bent with respect to the ink flow through the supply and return tubes, respectively.

6. An ink jet recorder according to claim 1, wherein the ink jet head has the ink tube formed therein, the tank being a detachable cartridge.

7. An ink jet recorder comprising:

a tank for storing ink;

an ink jet head for ejecting the ink;

a supply tube for supplying the ink from the tank to the head, the supply tube having an upstream supply tube connected to the tank and a downstream supply tube connected to the head;

a return tube for returning the ink from the head to the tank, the return tube having an upstream return tube connected to the head and a downstream return tube connected to the tank;

a pump for circulating the ink through the tubes between the tank and the head;

a first joint for connecting the upstream and downstream supply tubes;

a second joint for connecting the upstream and downstream return tubes;

each of the first and second joints including a seal member having a passage formed therethrough such that the passage widens toward one open end of the seal member;

one of the first and second joints including a first connector having an open end for connection to the open end of the seal member, the first connector having a passage formed in the open end thereof such that the connector passage widens toward the open end of the first connector; and a filter fitted in one of the open ends of the first connector and the associated seal member;

the other joint including a second connector having a convex part shaped for engagement with the passage in the associated seal member, the second connector having a passage formed therein.

8. An ink jet recorder according to claim 7, wherein the joint fitted with the filter and the associated tubes are positioned such that that ink flows upward through the filter.

9. An ink jet recorder according to claim 7, and further comprising:

a third joint for connecting the ink jet head and the upstream return tube, the third joint having a passage formed therein; and a second filter fitted in the passage of the third joint.

10. An ink jet recorder according to claim 7, wherein the passages in the first connector and in the seal member are conical, and the convex part of the second connector is shaped for compressive contact with the conical surface of the passage in the associated seal member.

11. An ink jet recorder according to claim 7, wherein the first and second connectors are formed integrally.

12. An ink jet recorder according to claim 7, wherein each of the first and second joints is connected to a third connector for being engaged with the other open end of the associated seal member.

13. An ink jet recorder according to claim 7, and further comprising a head unit for mounting the recording head thereon, the joints being fitted to the head unit.

14. An ink jet recorder comprising:

a tank for storing ink;

an ink jet head for ejecting the ink;

a supply tube for supplying the ink from the tank to the head, the supply tube having an upstream supply tube connected to the tank and a downstream supply tube connected to the ink jet head;

a return tube for returning the ink from the ink jet head to the tank, the return tube having an upstream return tube connected to the ink jet head and a downstream return tube connected to the tank;

a pump for circulating the ink through the supply and return tubes between the tank and the ink jet head;

a first joint for connecting the upstream and downstream supply tubes;

a second joint for connecting the upstream and downstream return tubes;

one of the joints including a first seal member and a first connector, the first seal member having a passage formed therethrough such that the passage widens toward one open end of the first seal member, the first connector having an open end for connection to the open end of the first seal member, the first connector having a passage formed in the open end thereof such that the first connector passage widens toward the open end of the first connector; and a filter fitted in one of the open ends of the first connector and the first seal member;

the other joint including a second connector and a second seal member;

the second connector being substantially identical in shape with the first connector, the second connector having a passage formed therein such that the second connector passage widens toward the open end of the second connector;

the second seal member having a convex open end shaped for engagement with the second connector passage, the second seal member having a passage formed therein.

15. An ink jet recorder according to claim 14, wherein the joint fitted with the filter and the associated tubes are positioned such that that ink flows upward through the filter.

16. An ink jet recorder according to claim 14, and further comprising:

a third joint for connecting the ink jet head and the upstream return tube, the third joint having a passage formed therein; and a filter fitted in the passage of the third joint.

17. An ink jet recorder according to claim 14, wherein the passages in the connectors and in the first seal member are conical, and the convex end of the second seal member is shaped for compressive contact with the conical surface of the passage in the second connector.

18. An ink jet recorder according to claim 14, wherein the first and second connectors are formed integralty.

19. An ink jet recorder according to claim 14, wherein each of the first and second joints is connected to a third connector for being engaged with the other open end of the associated seal member.

20. An ink jet recorder according to claim 14, and further comprising a head unit for mounting the recording head thereon, the first and second joints being fitted to the head unit.

21. An ink jet recorder comprising:

an ink tank;

an ink jet head;

a first tube connected to the ink jet head;

a second tube connected to the tank;

a connecting member for connecting the first and second tubes, the connecting member including a first connector and a second connector each having a passage formed therein, the passage having a conical open end for connection to the conical open end of the passage in the other connector; and a filter interposed between the first and second connectors;

the second connector being made of sealing material.

22. An ink jet recorder according to claim 21, wherein the connecting member is positioned such that that ink can flows upward through the filter.

23. An ink jet recorder according to claim 21, and further comprising:

a head holder for holding the ink jet head; and a mounting member for mounting the connectors on the head holder;

the connectors being kept in engagement by the engagement of one of the connectors with the mounting member.

24. An ink jet recorder according to claim 21, wherein each of the first and second tubes includes a supply tube and a return tube for circulating ink between the ink tank and the ink jet head, the connecting member including first and second connecting members each including the first and second connectors, the first connecting member connecting the supply tubes of the first and second tubes, the second connecting member connecting the return tubes of the first and second tubes.

25. An ink jet recorder according to claim 24, wherein the first connectors of the two connecting members are formed integrally, and the second connectors of the two connecting members are seal members which are formed integrally.

26. An ink jet recorder according to claim 25, wherein each connector of each connecting member has an end surface for contact with the end surface of the other connector, the end surface of one of the connectors of each connecting member having a ridge formed thereon for sealing between the end surfaces of the connectors.

27. The ink jet recorder of claim 21, wherein the second connector is made of rubber.

28. An ink jet recorder comprising:

an ink tank;

a head holder;

an ink jet head mounted on the holder for ejecting the ink onto a recording medium;

a carriage for mounting the holder thereon and moving the ink jet head over the medium;

a first tube connected to the ink jet head;

a second tube connected to the tank;

a connecting member for connecting the first and second tubes; and a mounting member for mounting the connecting member on one of the holder and the carriage;

a retainer formed on one of the head holder and the carriage so that the retainer retains the mounting member with play.

29. An ink jet recorder according to claim 28, wherein the mounting member is retained within an inner side of the retainer with play which is substantially perpendicular to an axis of the connecting member; and a protrusion formed on at least one of the mounting member and the retainer for preventing the mounting member from falling axially of the connecting member.

30. An ink jet recorder according to claim 29, wherein the protrusion is made of material which elastically deforms in such directions as to allow the mounting member to be retained within the retainer.

31. An ink jet recorder according to claim 30, wherein the connecting member includes a first connector connected to the first tube and a second connector connected to the second tube, the first and second connectors being fitted to the mounting member and the carriage, respectively.

32. An ink jet recorder according to claim 31, wherein each of the first and second tubes includes a supply tube and a return tube for circulating ink between the ink tank and the ink jet head, the connecting member including first and second connecting members each including the first and second connectors, the first connecting member connecting the supply tubes of the first and second tubes, the second connecting member connecting the return tubes of the first and second tubes.

33. An ink jet recorder according to claim 32, wherein each of the first and second connecting members further includes:

a seal member interposed between the first and second connectors of each connecting member for connecting the connectors;

the first connector of each connecting member being connected to the supply tube or the return tube of the first tube;

the second connector of each connecting member being connected to the supply tube or the return tube of the second tube.

34. An ink jet recorder according to claim 33, wherein the first and second connectors are fitted to the head holder and the carriage, respectively, at least one of the connectors of each connecting member being fitted with play.

35. An ink jet recorder according to claim 28, wherein the ink tank is fixed in the recorder.

36. The ink jet recorder of claim 28, wherein the retainer includes pins extending downward from the head holder.

* * * * *